US010688685B2

(12) United States Patent
Monachino

(10) Patent No.: US 10,688,685 B2
(45) Date of Patent: Jun. 23, 2020

(54) FORMWORK FOR PROVIDING A CONCRETE FOUNDATION PLINTH WITH EXPOSED HORIZONTAL REINFORCING BARS, PLINTH PROVIDED WITH SUCH FORMWORK, AND STRUCTURE COMPRISING SUCH PLINTH

(71) Applicant: Gabriele Monachino, Milan (IT)

(72) Inventor: Gabriele Monachino, Milan (IT)

( * ) Notice: Subject to any disclaimer, the term of this patent is extended or adjusted under 35 U.S.C. 154(b) by 18 days.

(21) Appl. No.: 15/778,659

(22) PCT Filed: Nov. 17, 2016

(86) PCT No.: PCT/EP2016/078055
§ 371 (c)(1),
(2) Date: May 24, 2018

(87) PCT Pub. No.: WO2017/093042
PCT Pub. Date: Jun. 8, 2017

(65) Prior Publication Data

US 2018/0345535 A1 Dec. 6, 2018

(30) Foreign Application Priority Data

Dec. 4, 2015 (IT) ..... 102015000080210

(51) Int. Cl.
*B28B 23/02* (2006.01)
*B28B 7/00* (2006.01)
(Continued)

(52) U.S. Cl.
CPC ..... *B28B 23/024* (2013.01); *B28B 7/0011* (2013.01); *E02D 27/013* (2013.01)

(58) Field of Classification Search
CPC ... B28B 7/0011; B28B 23/022; B28B 23/024; E02D 27/013; E02D 27/42; E02D 27/425
(Continued)

(56) References Cited

U.S. PATENT DOCUMENTS 748,242 A * 12/1903 Weber ..... E04H 12/28 52/218
1,705,742 A * 3/1929 Werner ..... E04H 12/2261 52/149
(Continued)

FOREIGN PATENT DOCUMENTS

CN 108673714 A * 10/2018 ..... B28B 7/0011
DE 3302821 A1 8/1984
(Continued)

OTHER PUBLICATIONS

Translation of CN 108673714-A (Year: 2018).*
(Continued)

*Primary Examiner* — Michael Safavi
(74) *Attorney, Agent, or Firm* — Lucas & Mercanti, LLP

(57) ABSTRACT

A formwork for providing a plinth with concrete frame and with exposed horizontal reinforcing bars, is disclosed. The framework has a base the shape of which in plan view corresponds to the concrete frame. Each side of the base is provided with inner and outer lateral containment walls which extend vertically from the base to make a casting chamber for the concrete. The inner walls have a plurality of openings for the insertion from above of a plurality of longitudinal reinforcing bars. At least one of the outer walls is provided with a plurality of openings for the insertion by transverse sliding of a plurality of transverse reinforcing bars. The openings are provided with inflatable elements which are configured to transition from a deflated configuration, in which the bars can freely slide in the openings, to an inflated configuration, in which the bars are locked in position. The chamber is watertight in order to prevent concrete from coming out during casting.

3 Claims, 36 Drawing Sheets

(51) Int. Cl.
*E02D 27/01* (2006.01)
*E02D 27/42* (2006.01)

(58) Field of Classification Search
USPC ..... 425/440; 52/295, 296, 299; 249/85, 96, 249/97, 142, 144
See application file for complete search history.

(56) References Cited

U.S. PATENT DOCUMENTS 2,164,428 A * 7/1939 Rhodes ..... E21B 15/00 52/295
2,625,815 A * 1/1953 Black ..... E04H 12/2261 52/126.1
2,948,995 A * 8/1960 Cogan ..... E04B 1/21 52/259
3,916,635 A * 11/1975 Lynch ..... E02D 5/38 405/253
4,328,651 A * 5/1982 Gutierrez ..... E02D 27/02 52/169.9
4,661,010 A * 4/1987 Almer ..... E01F 15/088 404/6
4,673,157 A * 6/1987 Wells ..... E02D 27/02 249/13
4,716,696 A * 1/1988 Yacoboni ..... E02D 27/42 52/167.1
4,767,241 A * 8/1988 Wells ..... E02D 27/02 405/231
5,257,489 A * 11/1993 Angelette ..... E02D 27/42 405/252
5,678,382 A * 10/1997 Naito ..... E02D 27/42 52/295
6,571,521 B1 * 6/2003 Ameigh ..... E04C 1/395 256/1
7,290,750 B2 * 11/2007 Huber ..... E02D 27/02 249/117
8,161,698 B2 * 4/2012 Migliore ..... E02D 27/42 52/169.9
8,544,227 B2 * 10/2013 Gullette ..... E04C 3/34 52/295
8,646,232 B2 * 2/2014 Liskey ..... E02D 27/12 405/239
2002/0017068 A1 * 2/2002 Monachino ..... E02D 27/02 52/247
2008/0190058 A1 * 8/2008 Migliore ..... E02D 27/42 52/295

FOREIGN PATENT DOCUMENTS

EP 1767321 A1 3/2007
GB 572522 A * 10/1945 ..... B28B 23/024
JP S6290445 A 4/1987
JP H05331864 A 12/1993
JP 2003122098 A 4/2003
JP 2008013608 A 1/2008
JP 2008074271 A 4/2008
KR 10-2009-0116140 A 11/2009

OTHER PUBLICATIONS

International Search Report for International Application No. PCT/EP2016/078055 (9 Pages) (dated Jan. 30, 2017).
Search Report for corresponding Korean Patent Application No. KR10-2018-7018938 dated Jan. 15, 2019 and English Translation 14 pages.

* cited by examiner

FORMWORK FOR PROVIDING A CONCRETE FOUNDATION PLINTH WITH EXPOSED HORIZONTAL REINFORCING BARS, PLINTH PROVIDED WITH SUCH FORMWORK, AND STRUCTURE COMPRISING SUCH PLINTH

CROSS-REFERENCE TO RELATED APPLICATIONS

This application is a 371 of PCT/EP2016/078055, filed Nov. 17, 2016, which claims the benefit of Italian Patent Application No. 102015000080210, filed Dec. 4, 2015.

FIELD OF THE INVENTION

The present invention relates to a formwork for providing a concrete foundation element, in particular a plinth, obtained by virtue of such formwork and to the structures that comprise such plinth and at least one pillar.

BACKGROUND OF THE INVENTION

In particular, the present invention relates to a plinth with exposed horizontal reinforcing bars, i.e. at right angles to the direction of casting of the concrete, which make it possible, as will become clear hereinbelow, to form an optimal and advantageous connection with the corresponding pillars.

In the construction of buildings or of other building structures from concrete, the foundation elements, i.e. the base plinths and the corresponding pillars, are nowadays made and coupled together with a number of different traditional methods.

In the design of prefabricated structures, connections play an essential role in terms of seismic resistance of the entire building. Precisely for this reason, connections as classified as a function of their characteristics. A first distinction can be made on the basis of the position and function of the connections inside the structure, by defining the critical area as "the region of a primary seismic element where the most unfavorable combination of the effects of the actions arise, and where plastic hinges can form".

The connections can be arranged outside the critical regions, i.e. they must be positioned at a distance from the critical section at least equal to the maximum dimension of the transverse cross-section, and they do not influence the energy dissipation capacity of the structure. If they are instead arranged inside the critical regions, then there are two connection possibilities.

The first possibility comprises the use of connections that are suitably overdimensioned with respect to the rest of the structure, so that in the design seismic situation they remain elastic, while the nonelastic behavior occurs in the other critical regions. In this case, the reinforcements must be anchored outside the critical area and the reinforcement of the critical area must be anchored outside the connection.

The second possibility comprises the use of a connection inside the critical area with significant ductility that allows plastic rotations.

The first development of a prefabricated foundation was the socket plinth, which is very similar to a plinth cast in-situ, but with a hole to receive the prefabricated pillar at its center. Once the foot of the pillar is inserted in the socket, a casting of grouting with shrinkage-compensating concrete is necessary, which creates the solid medium between the plinth and the pillar, creating a permanent joint for the structure.

In a second type of connection, there are bars which protrude below the pillar and corrugated tubes embedded in the foundation plinth.

Connection with protruding bars can be used in foundations that are prefabricated (such as plinths) or cast in-situ. The fastening plate is a metal device which is embedded in the casting of the foundation, and its purpose is to support the pillar during the installation step and to allow it to be grouted with the foundation. It is constituted by a metal frame, which connects a series of corrugated tubes that are closed at the base, the function of which is to create compartments in the foundation, into which the matching bars of the pillar will be inserted.

The prefabricated pillar is therefore made with longitudinal bars exiting from the base section so as to be inserted into the holes of the corrugated tubular elements. Once the pillar is inserted, filling is carried out and a formwork is built for the completion casting with non-shrinking mortar in the corrugated tubes.

In a third type of connection between plinth and pillar, bolted column shoes are arranged on the base of the pillar.

The shoes are angled metal elements which are inserted at the foot of the pillar during casting, with an insert to leave the part above the shoes empty. In the plinth, corresponding anchor bolts, in the form of threaded steel elements with improved adherence, are anchored.

The pillar is anchored by clamping by way of nuts during the mounting. Finally, a supplementary casting is done using shrinkage-compensating mortar.

The anchor bolts in the foundation must be positioned exactly as specified in the design drawing. The use of templates is recommended to ensure that such anchorages are exactly positioned according to the dimensioning and in order to prevent shifts during the casting and vibration of the concrete.

The mounting steps are carried out in this order: once the pillar is ready and the anchor bolts are fixed in the foundation, remove the template, insert the metal plates for the mounting, and position the caps on the anchorages. Then lower the pillar, remove the caps and screw the nuts onto the anchor points, thus adjusting the vertical orientation of the pillar. At this point the pillar is immobilized in the foundation and the spaces left by the inserts and the joint between the foundation and the pillar must be filled with the mortar. This filling can be done by way of a tube left in the pillar or by way of a formwork around the joint.

Obviously it is also possible to provide both plinth and pillar directly in-situ.

SUMMARY OF THE INVENTION

Starting from such known art, the aim of the present invention is to provide a formwork for providing a concrete foundation element, in particular a plinth, which is configured so as to provide a plinth with exposed horizontal reinforcing bars. As will become clear hereinbelow, such particular plinth, which innovatively is provided with exposed horizontal reinforcing bars, will make it possible to achieve advantages both in technical terms and in economic terms in the provision of the connection between the plinth and the corresponding pillar.

In general these aims are achieved by virtue of a formwork and by virtue of the foundation plinth described herein.

Further characteristics of the invention are identified by the dependent claims.

BRIEF DESCRIPTION OF THE DRAWINGS

The characteristics and advantages of a formwork according to the present invention and of the foundation plinth obtained by virtue of such formwork will become better apparent from the following illustrative and non-limiting description, with reference to the accompanying schematic drawings in which.

DETAILED DESCRIPTION OF THE INVENTION

Figure 1:
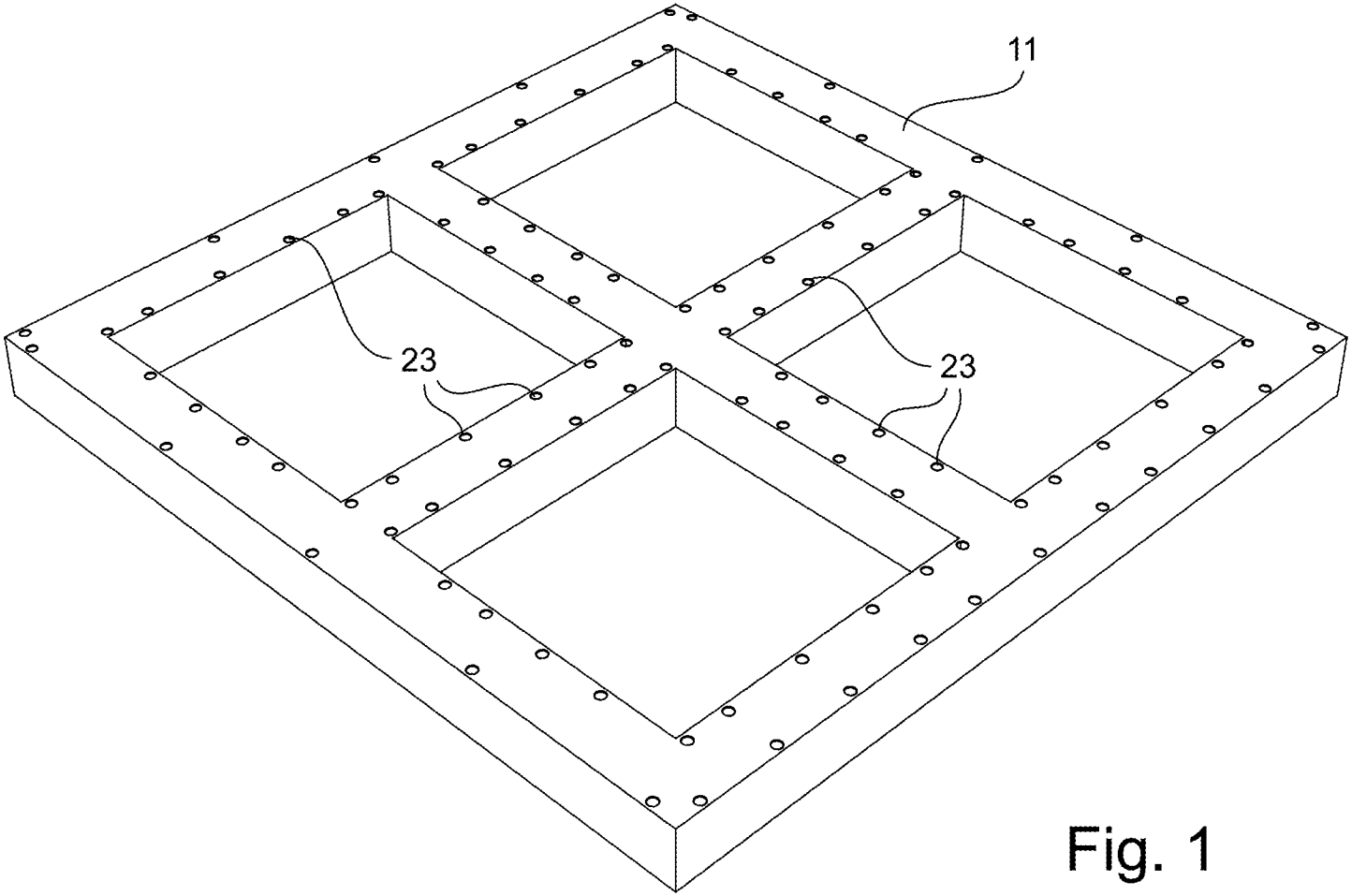
FIGS. 1 to 4 show the steps of assembly of a formwork according to the present invention.
Figure 2:
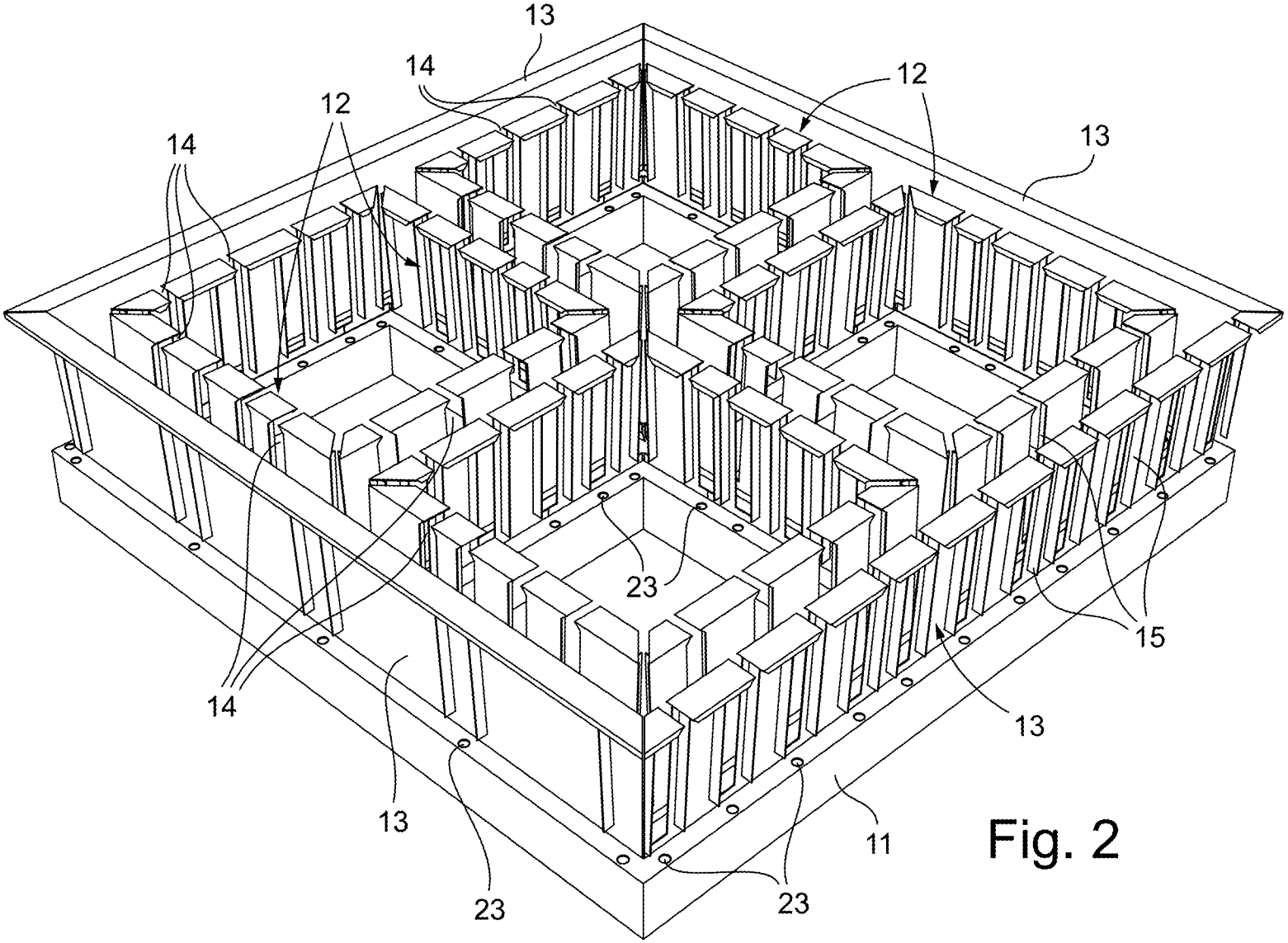
Figure 3:
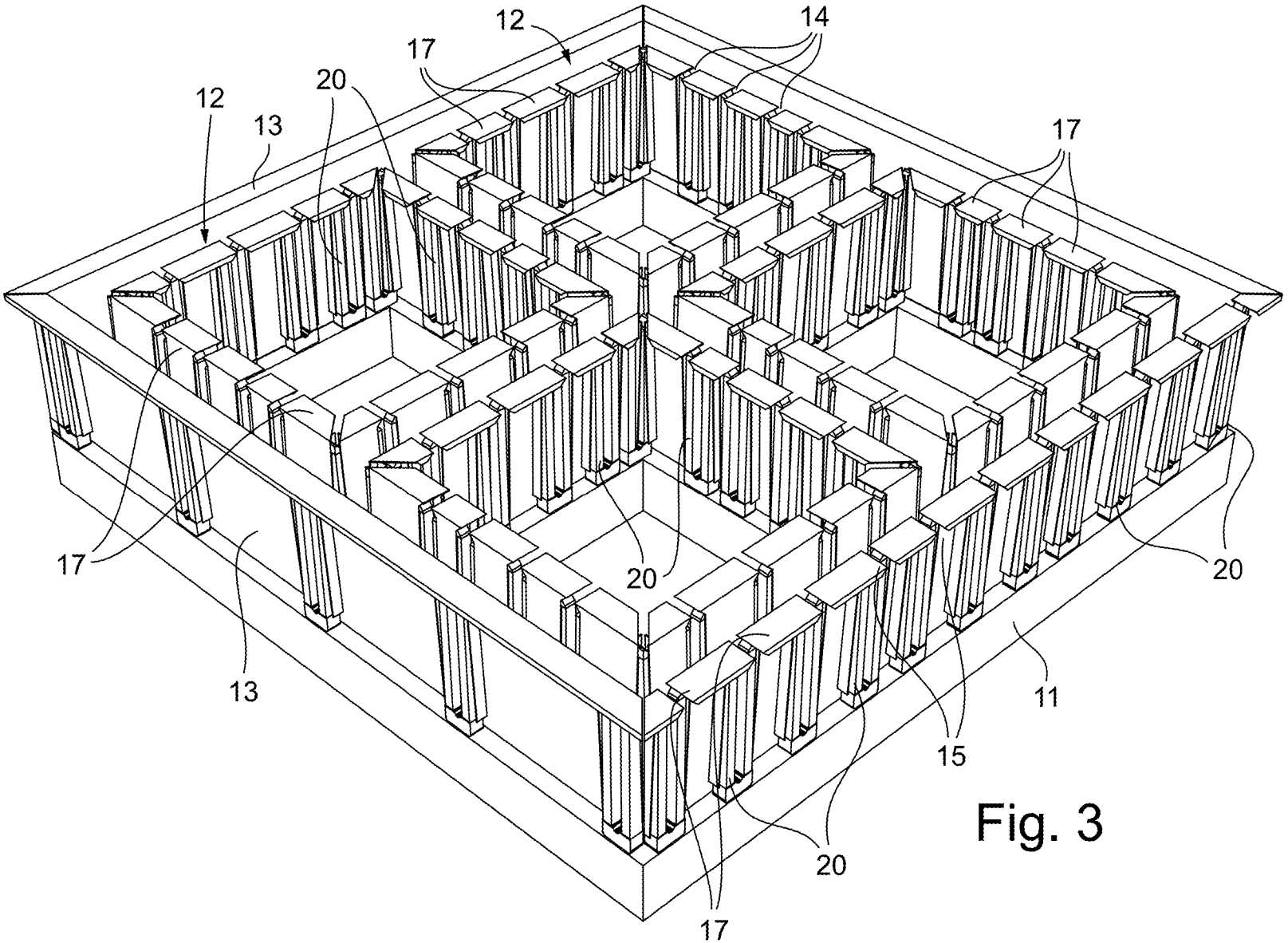
Figure 4:
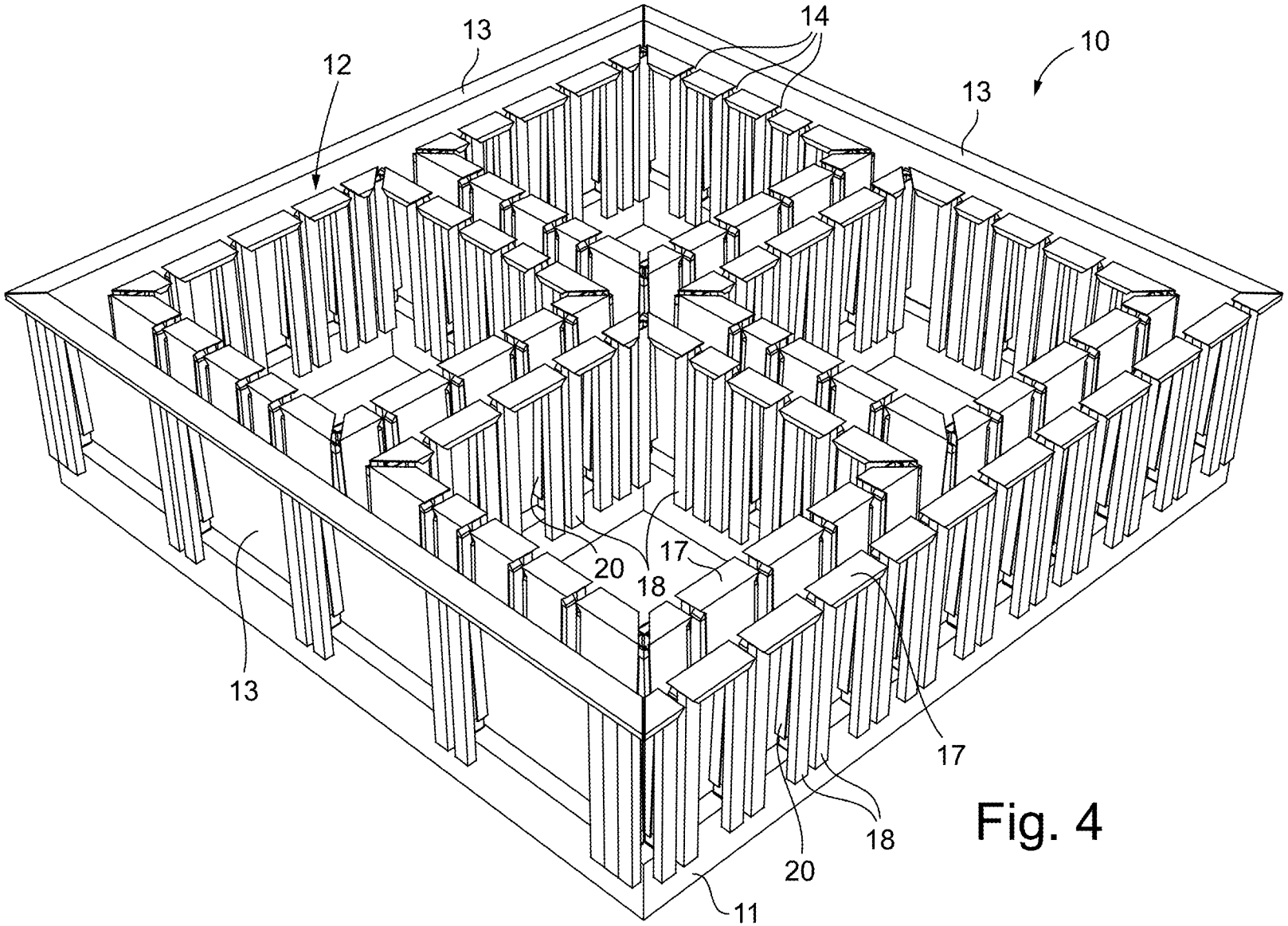
Figure 5:
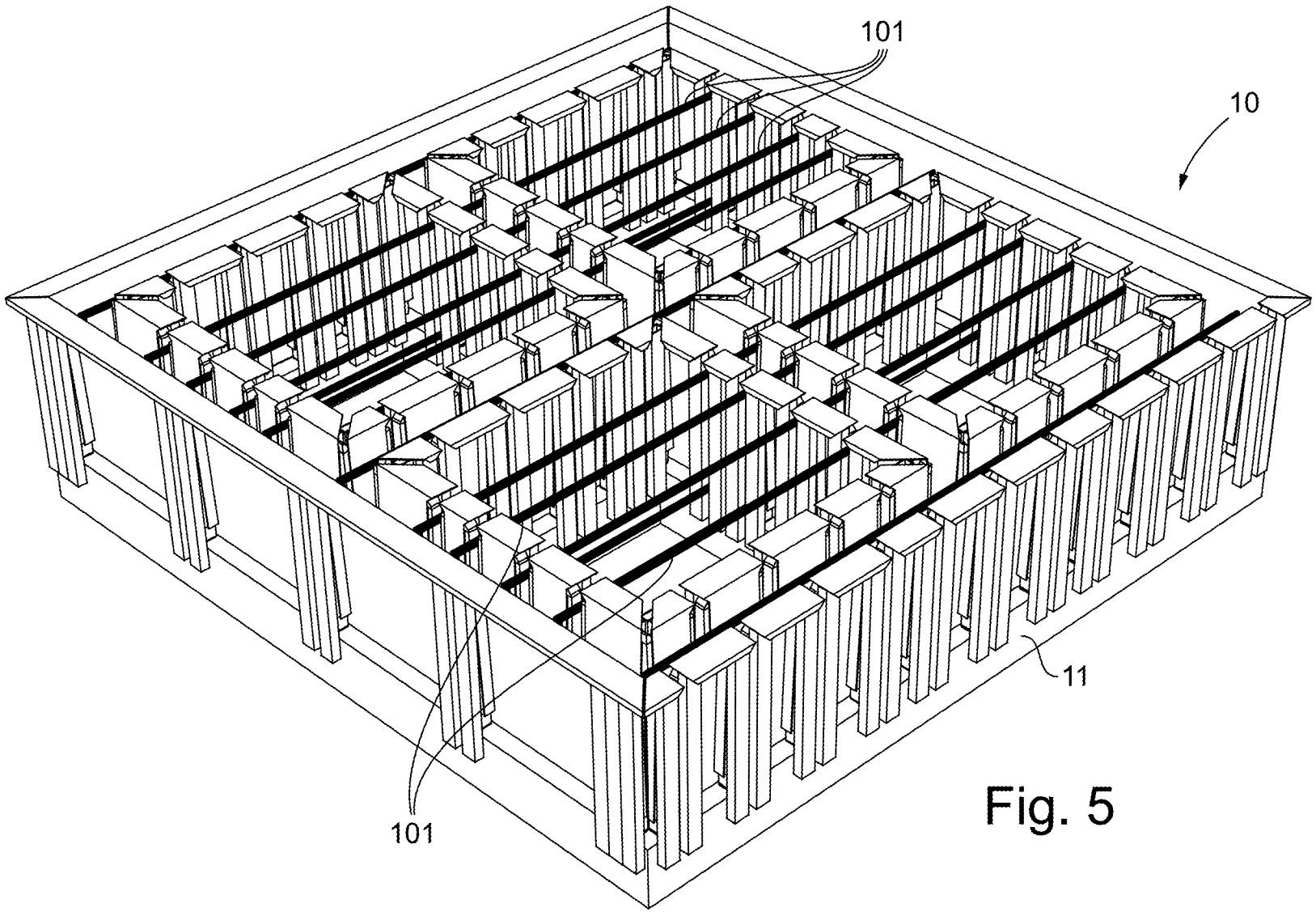
FIGS. 5 to 14 show the steps of using the formwork of FIGS. 1-4 to provide a foundation plinth according to the present invention.
Figure 6:
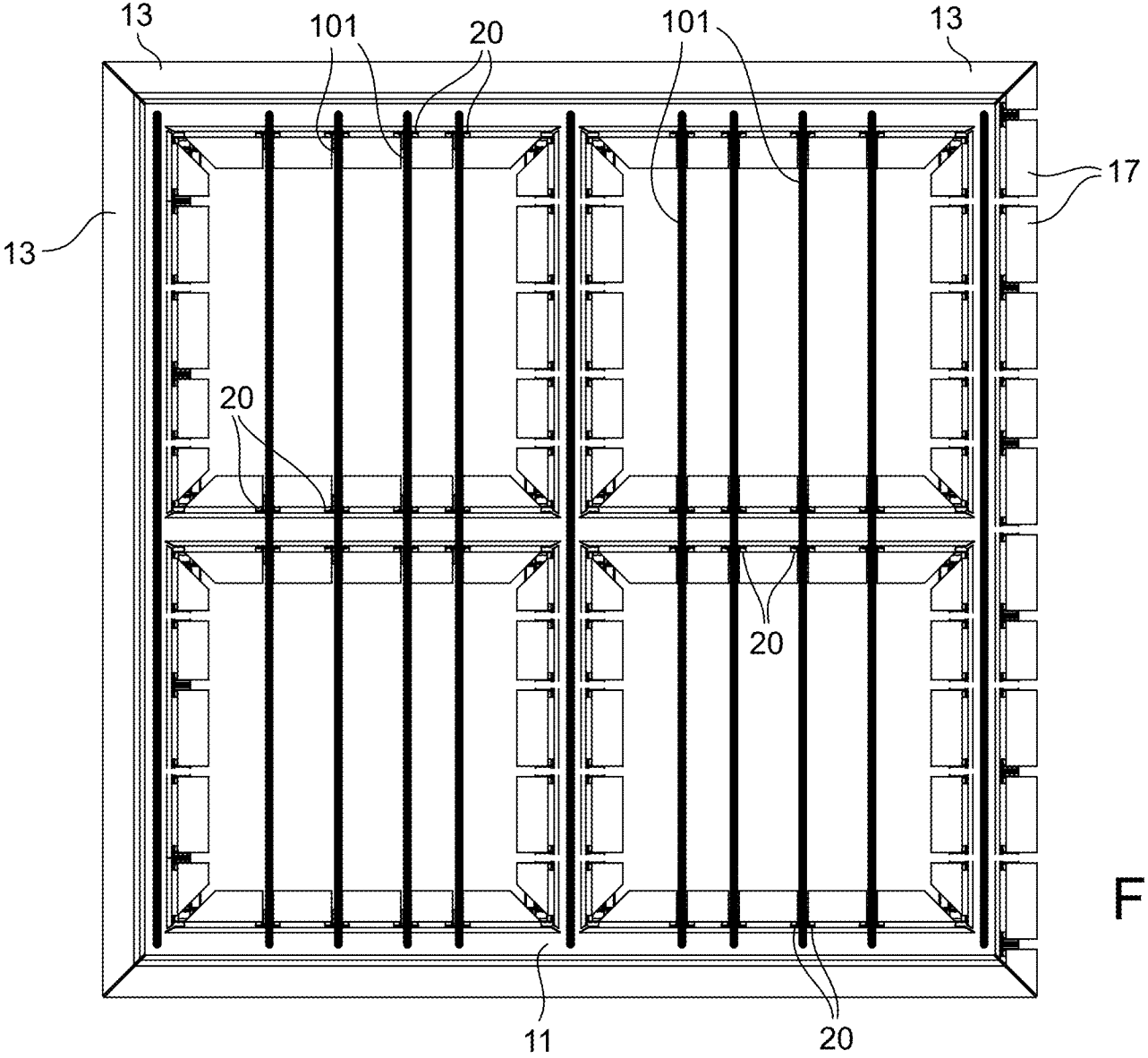
Figure 7:
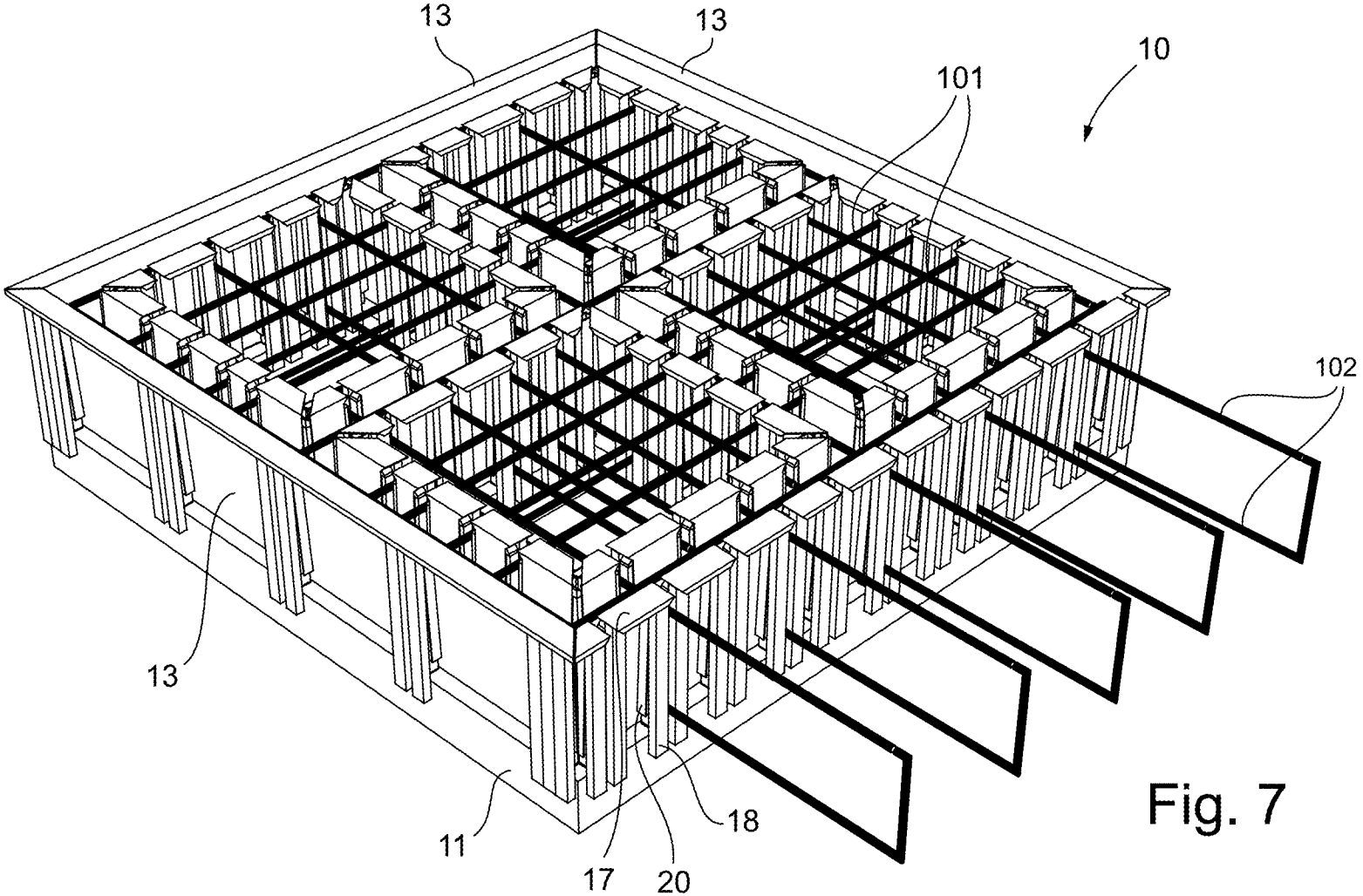
Figure 8:
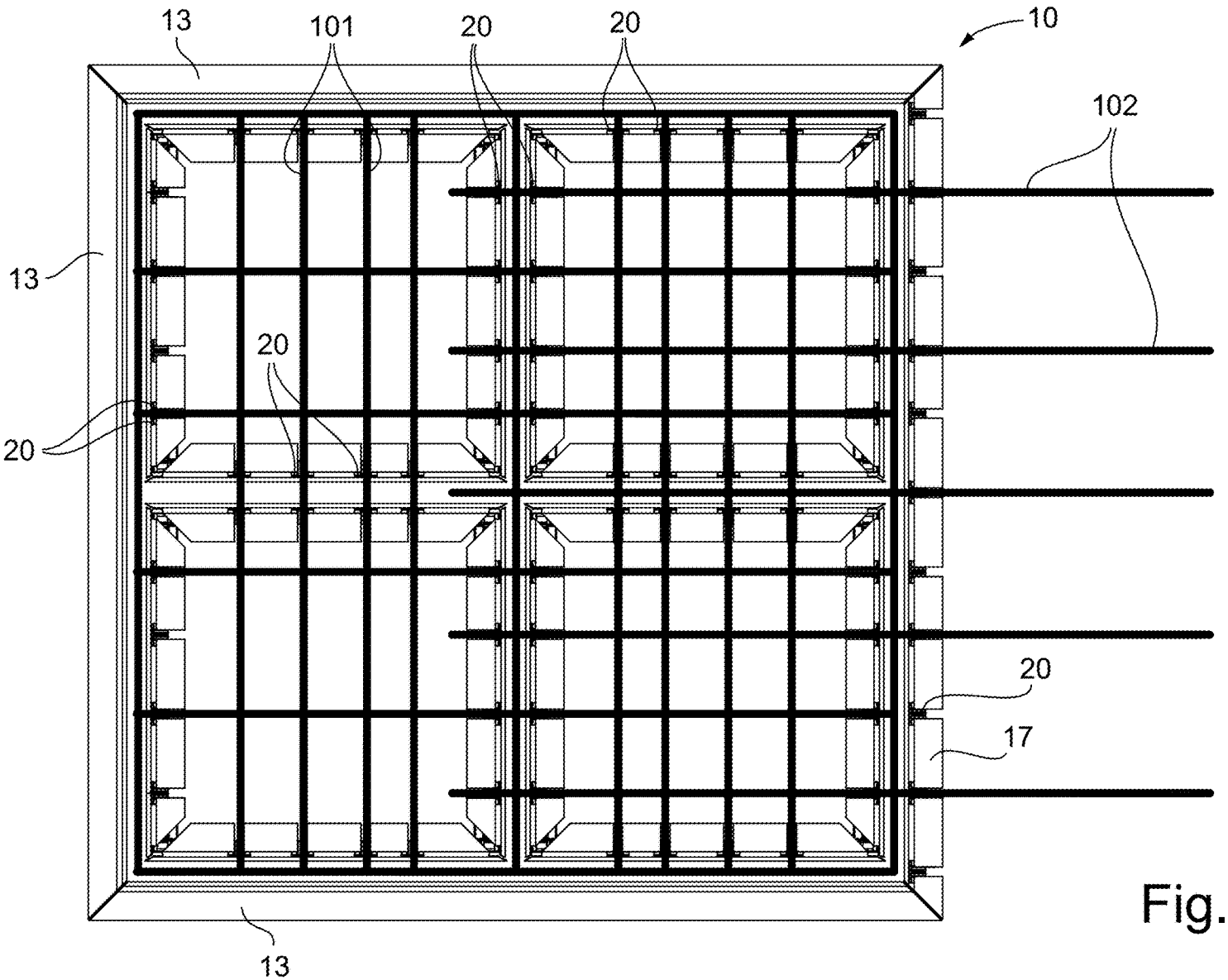
Figure 9:
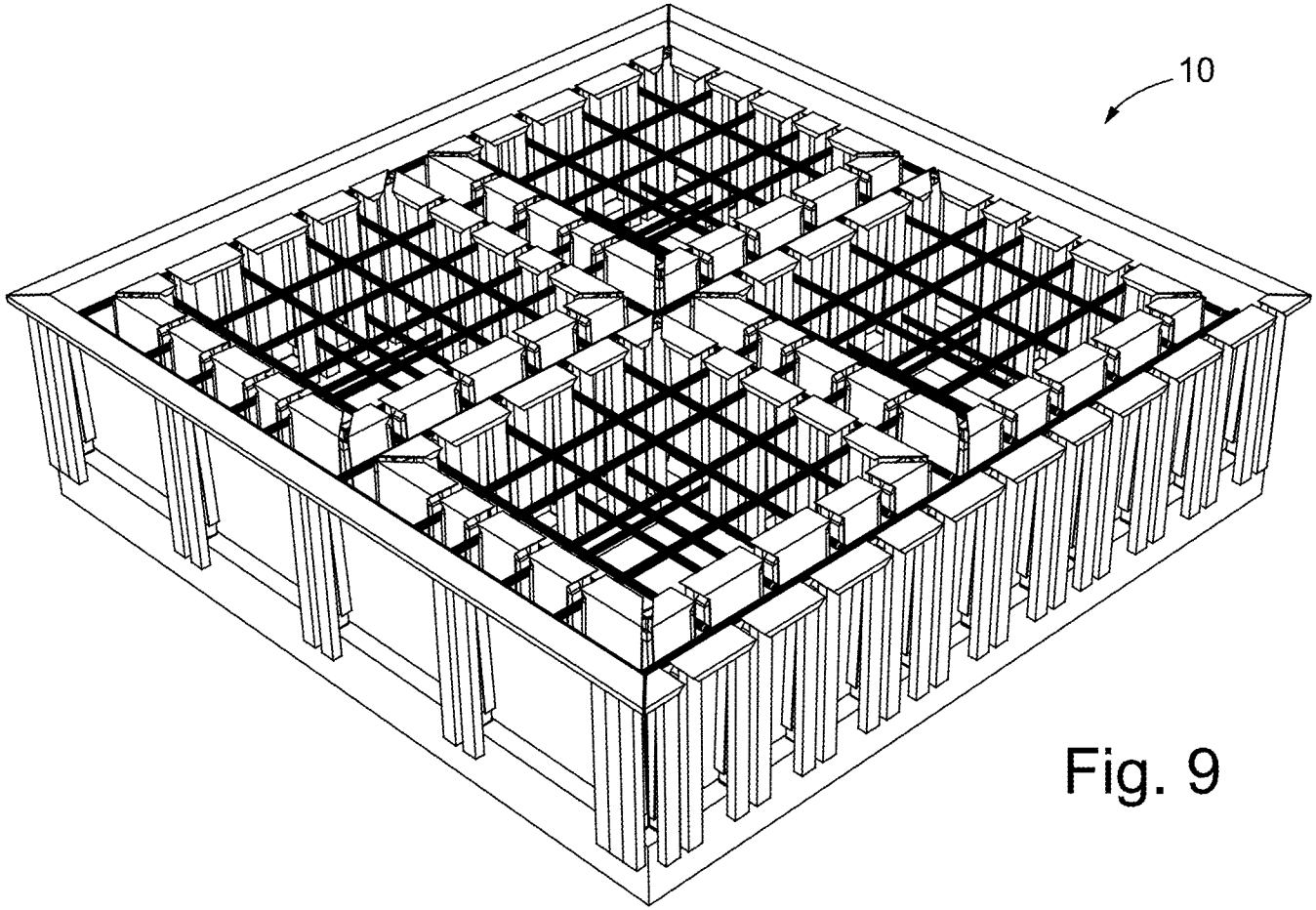
Figure 10:
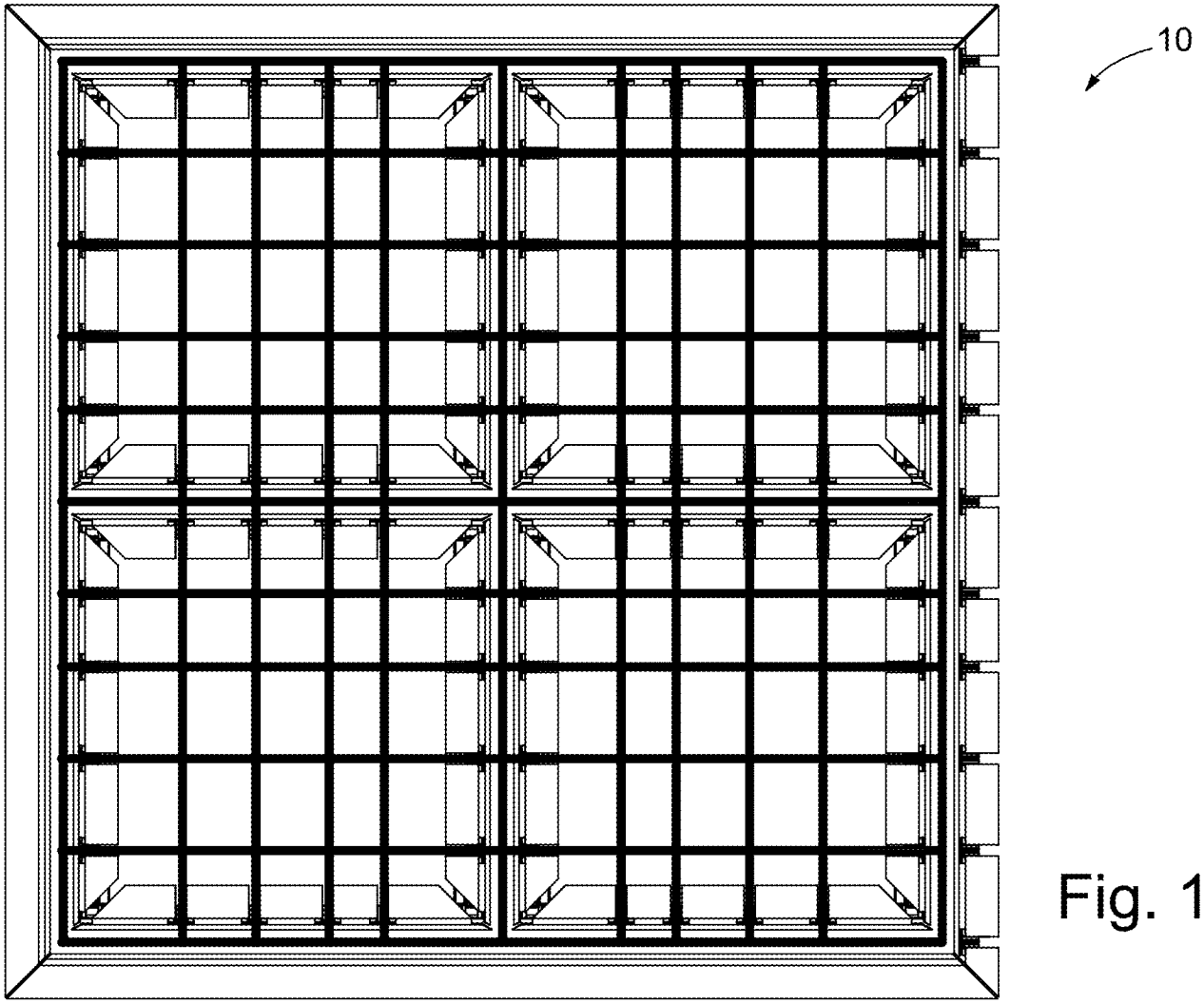
Figure 11:
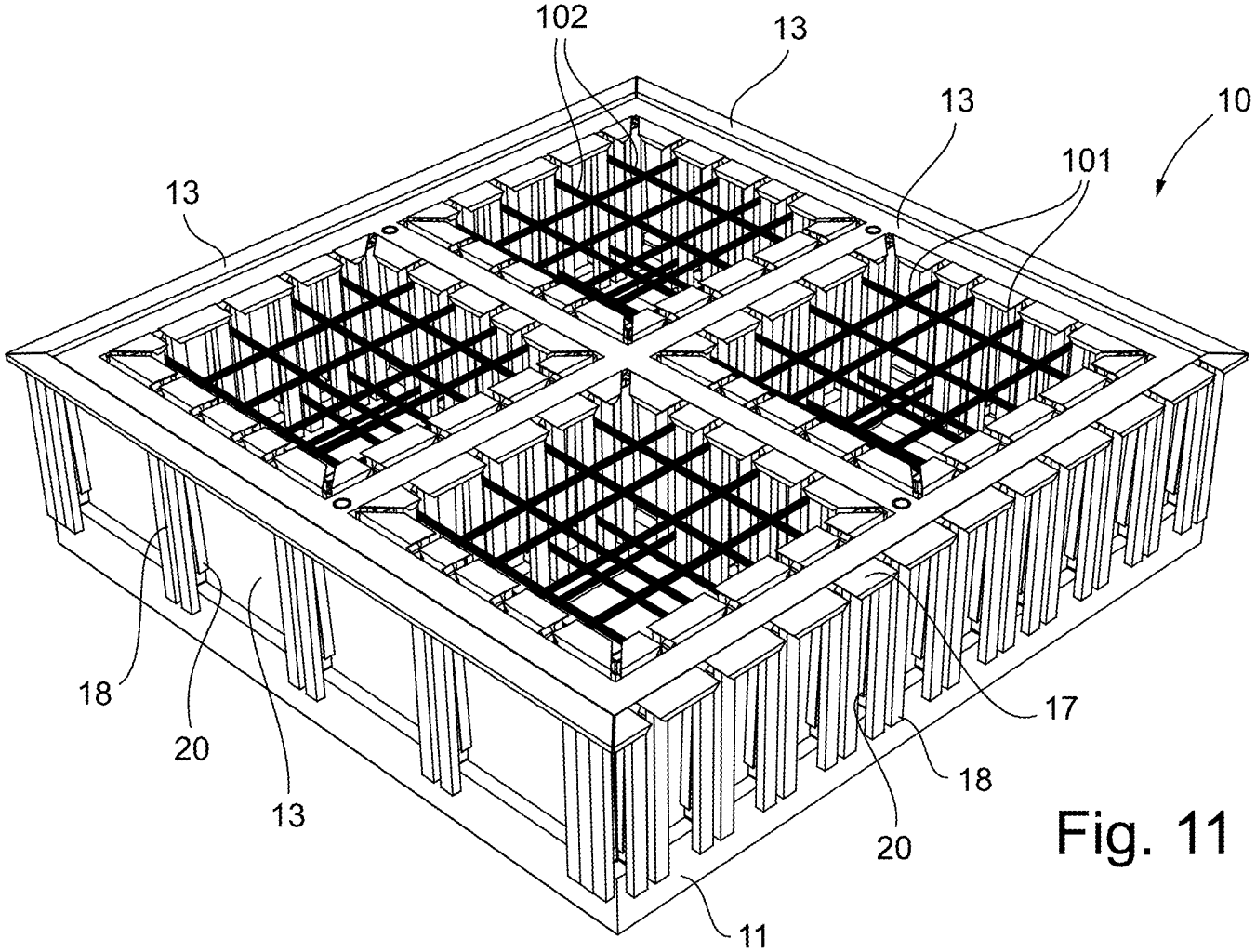
Figure 12:
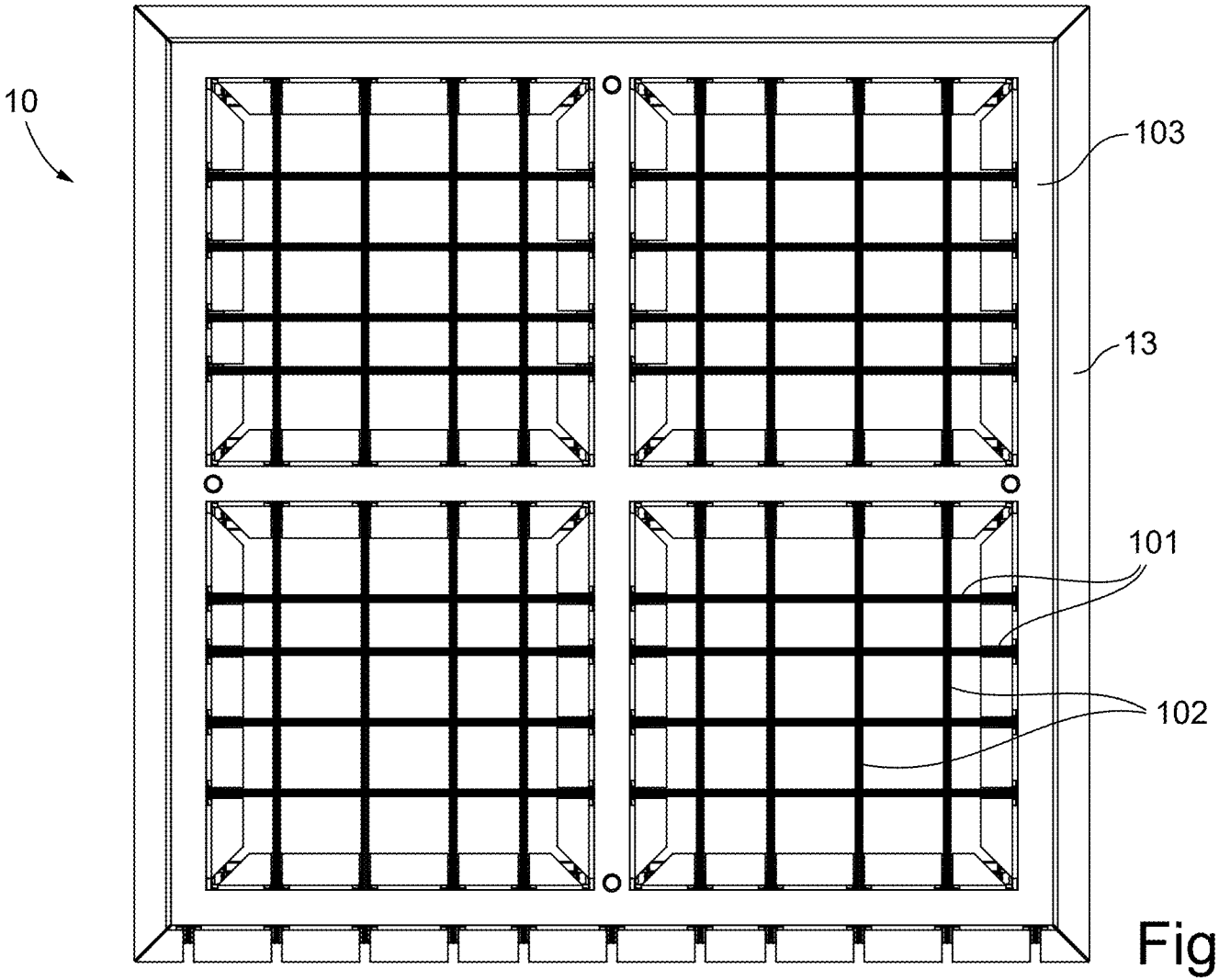
Figure 13:
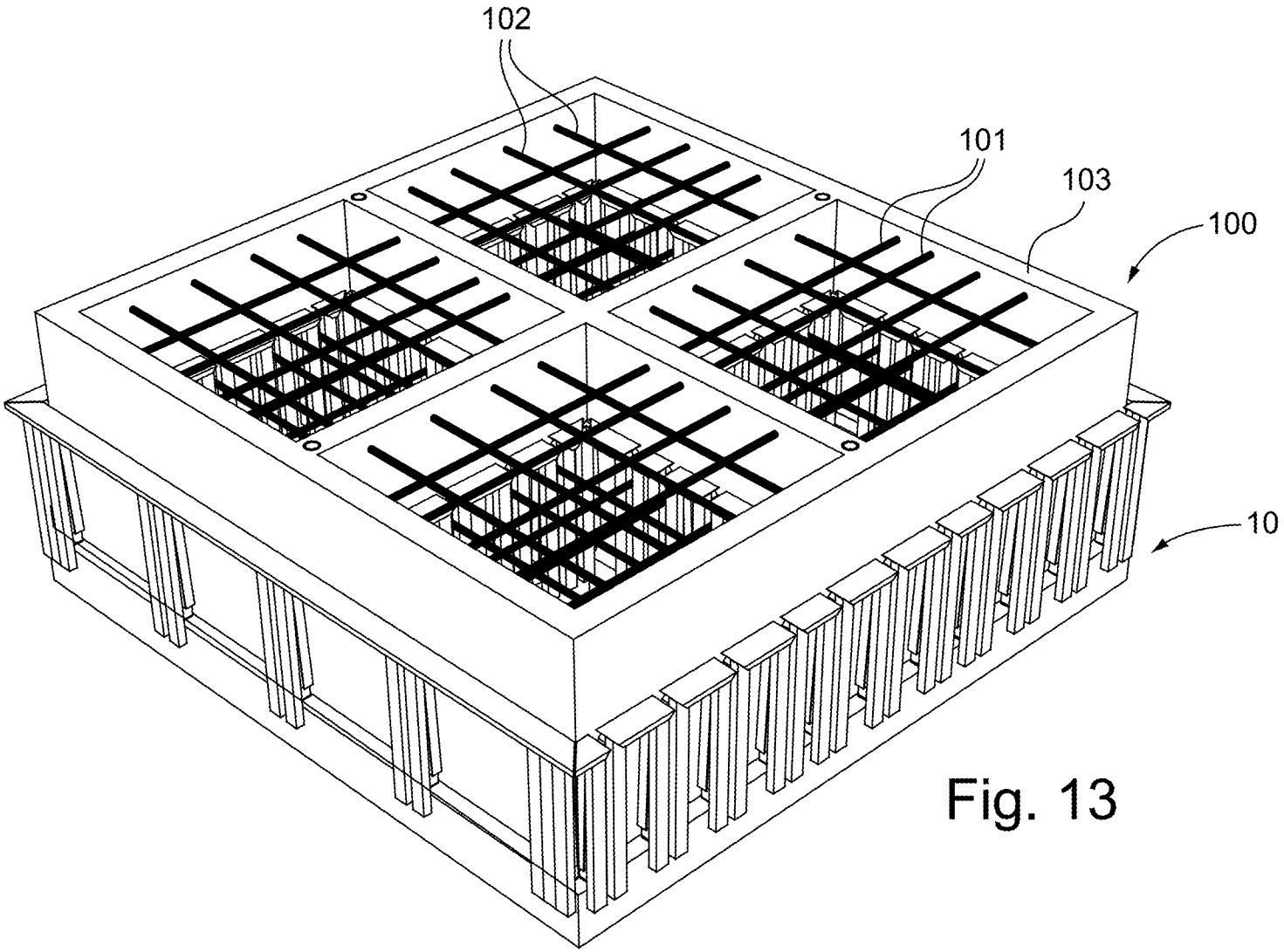
Figure 14:
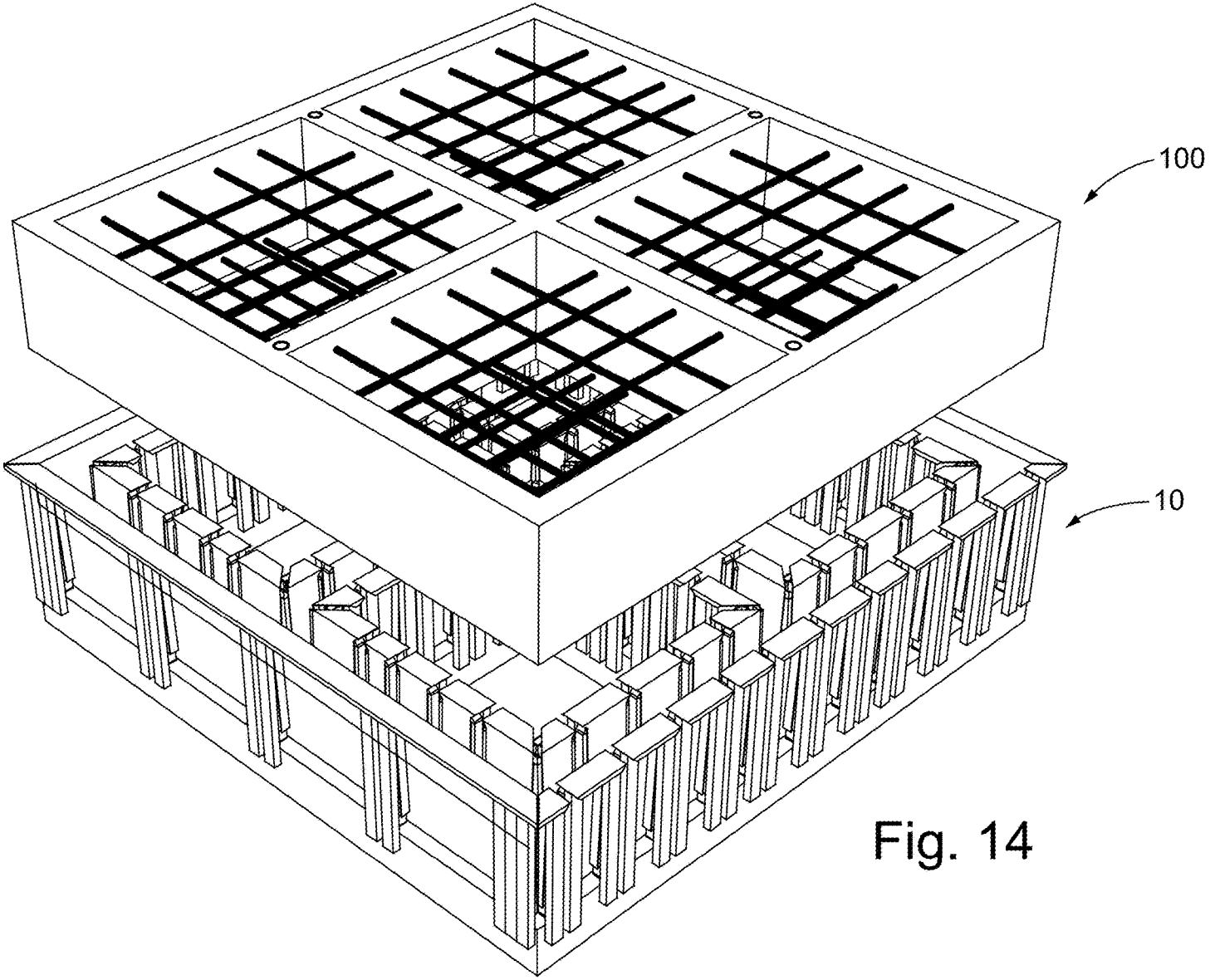
Figure 15:
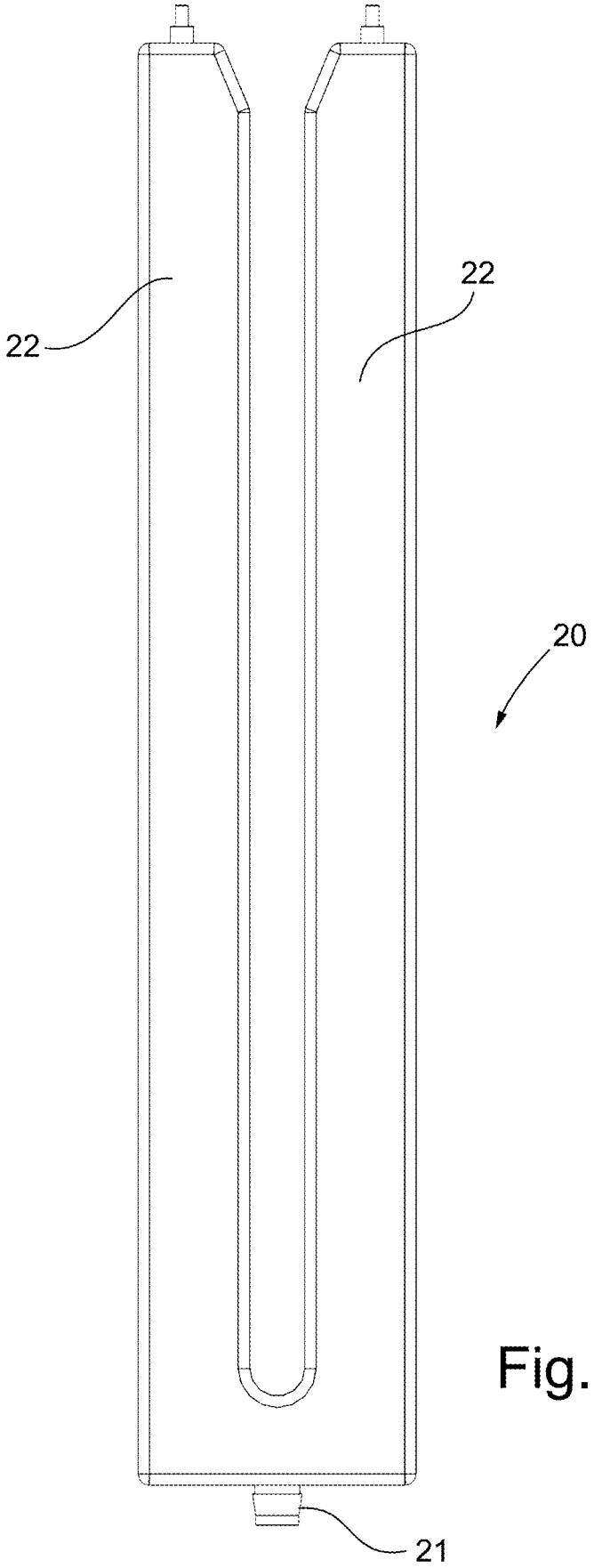
FIGS. 15 to 20 show particular inflatable elements integrated in the formwork of FIGS. 1-4, the function of which is to seal the reinforcements that protrude horizontally from the formwork, to close and open the facings of the formwork in order to further allow the easy extraction of the formed foundation plinth.
Figure 16:
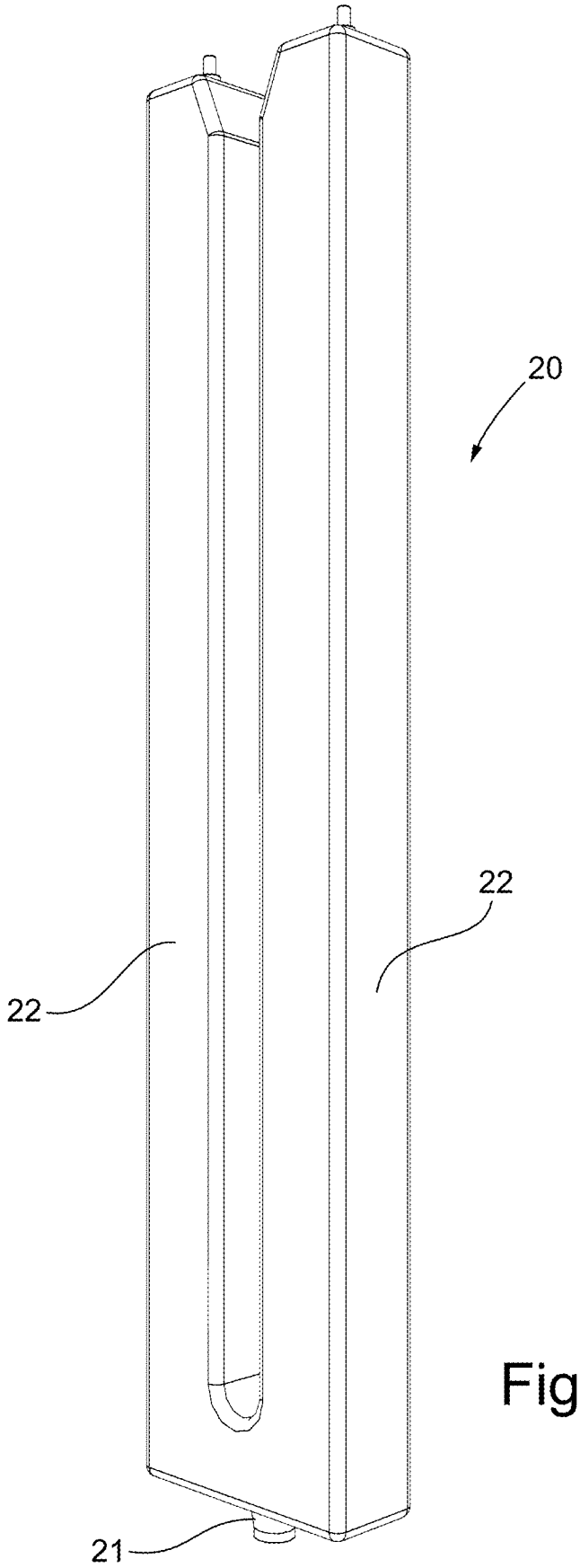
Figure 17:
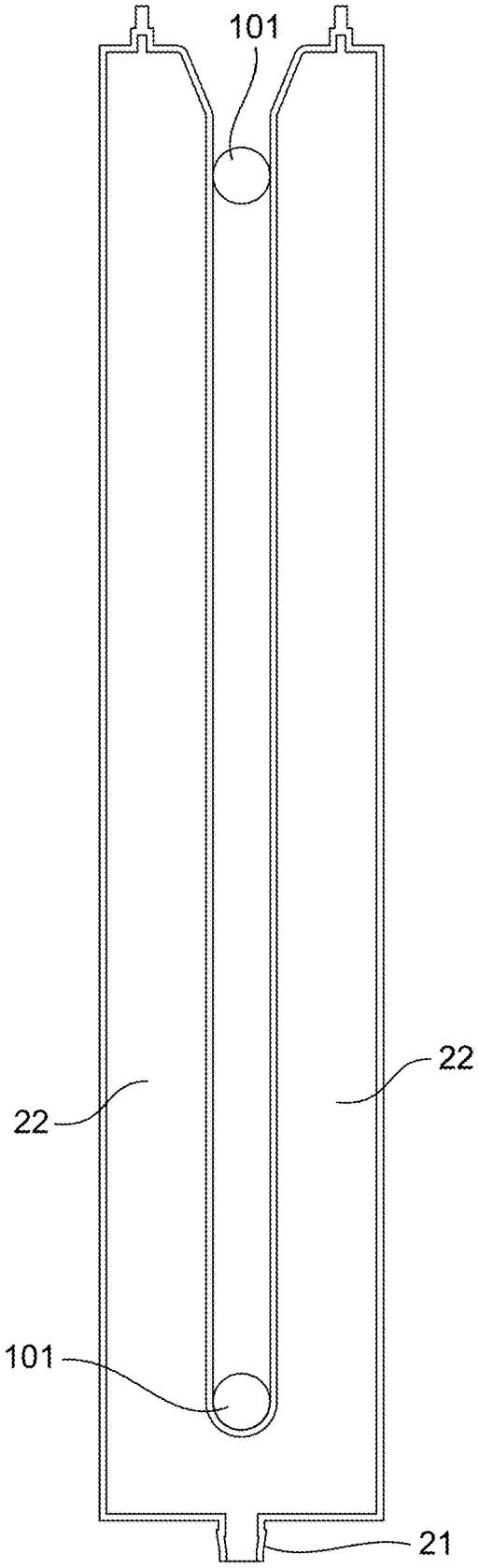
Figure 18:
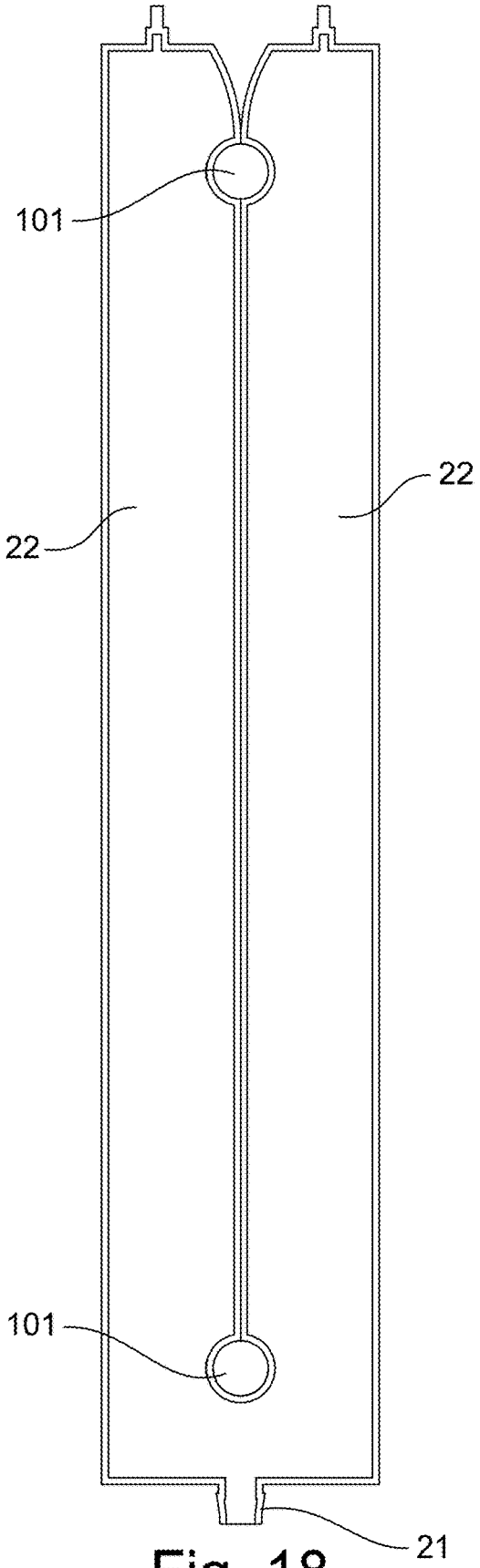
Figure 20:
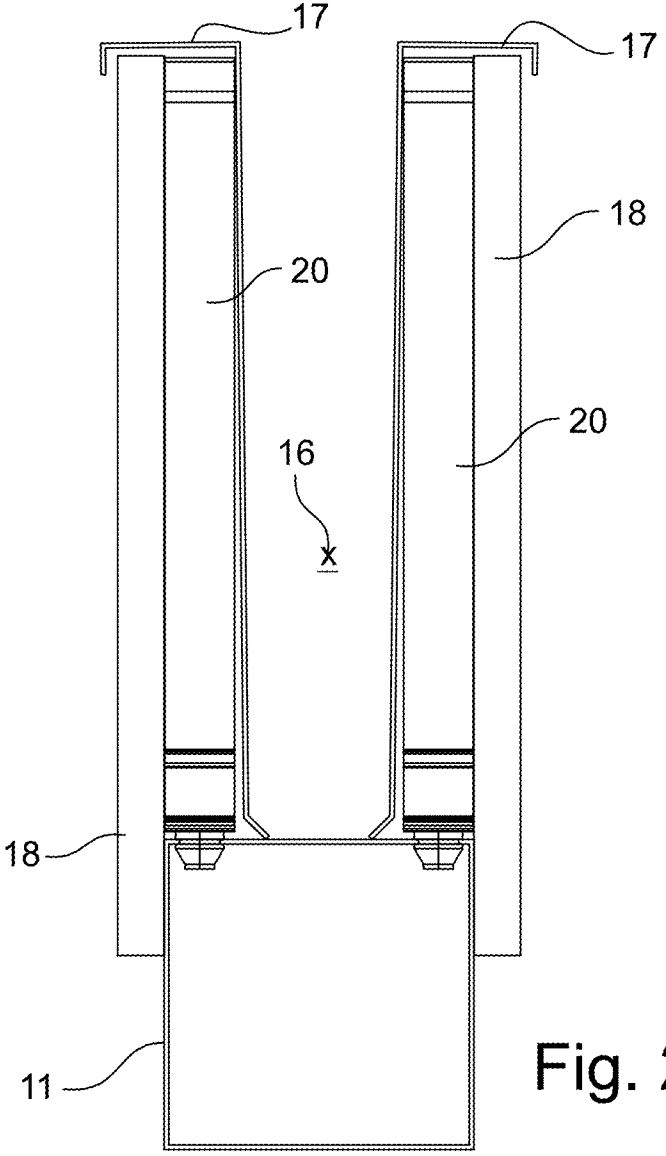
Figure 19:
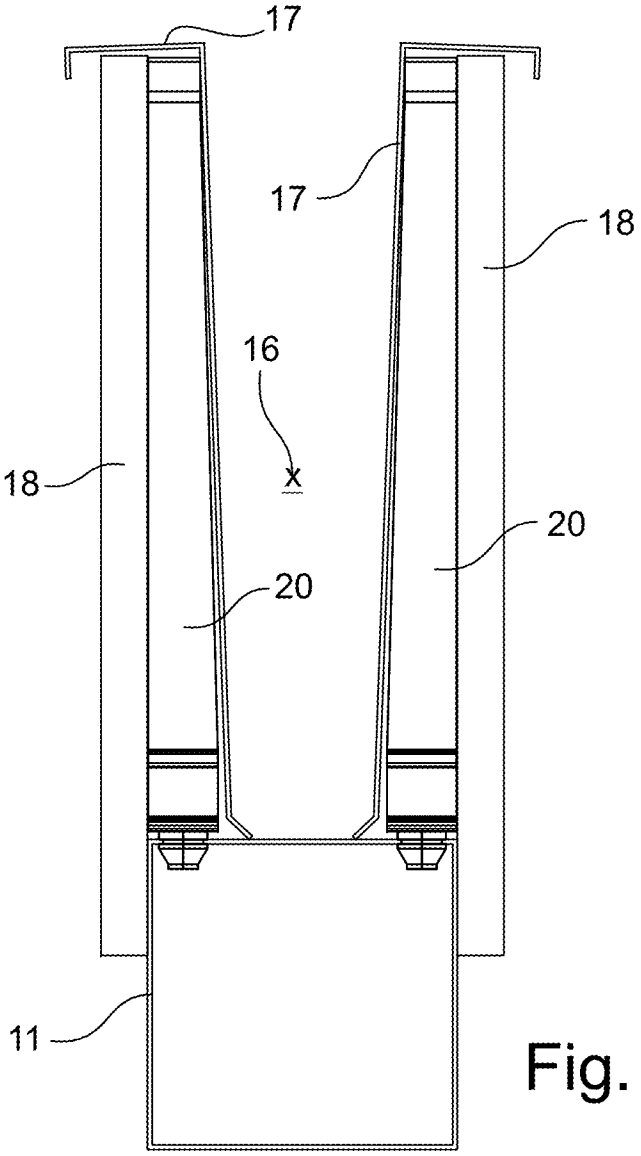
Figure 23:
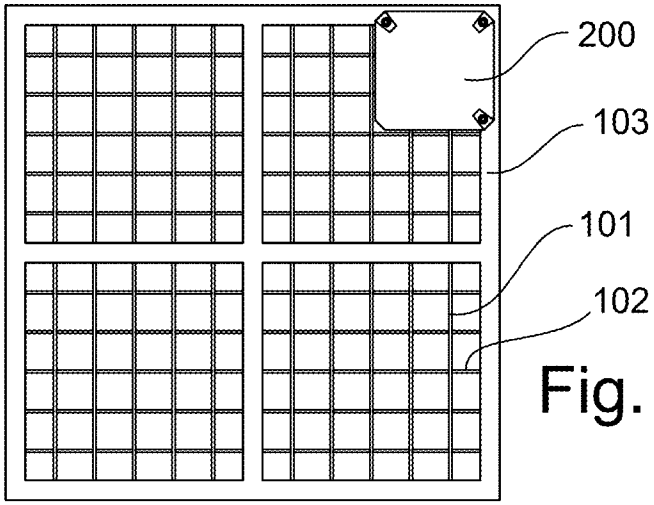
FIGS. 21 to 30 show various examples of plinths made according to the present invention.
Figure 24:
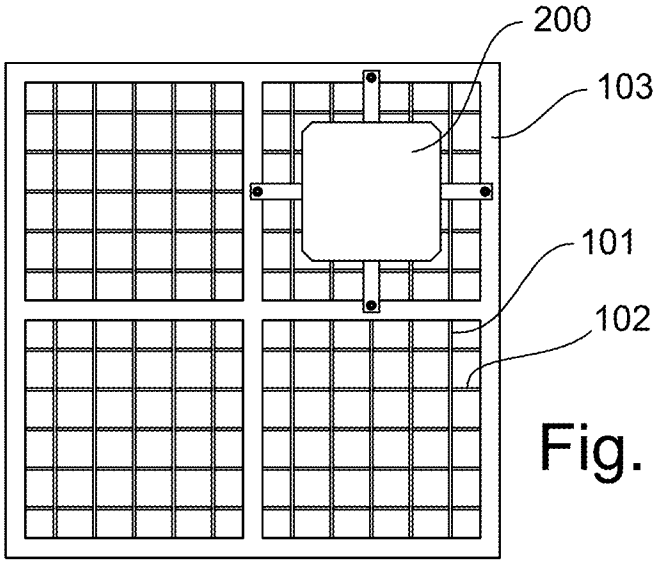
Figure 21:
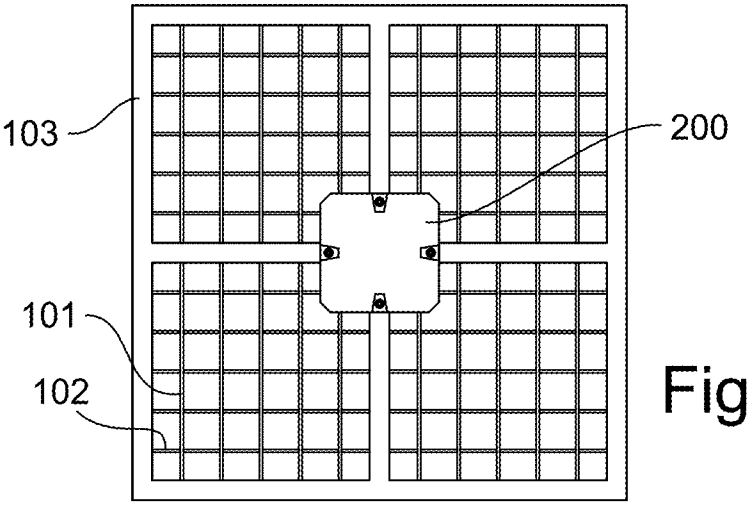
Figure 22:
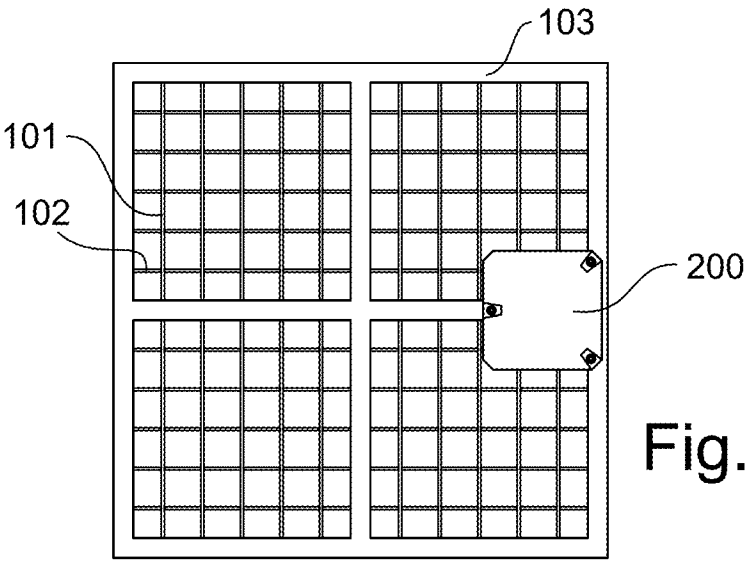
Figure 26:
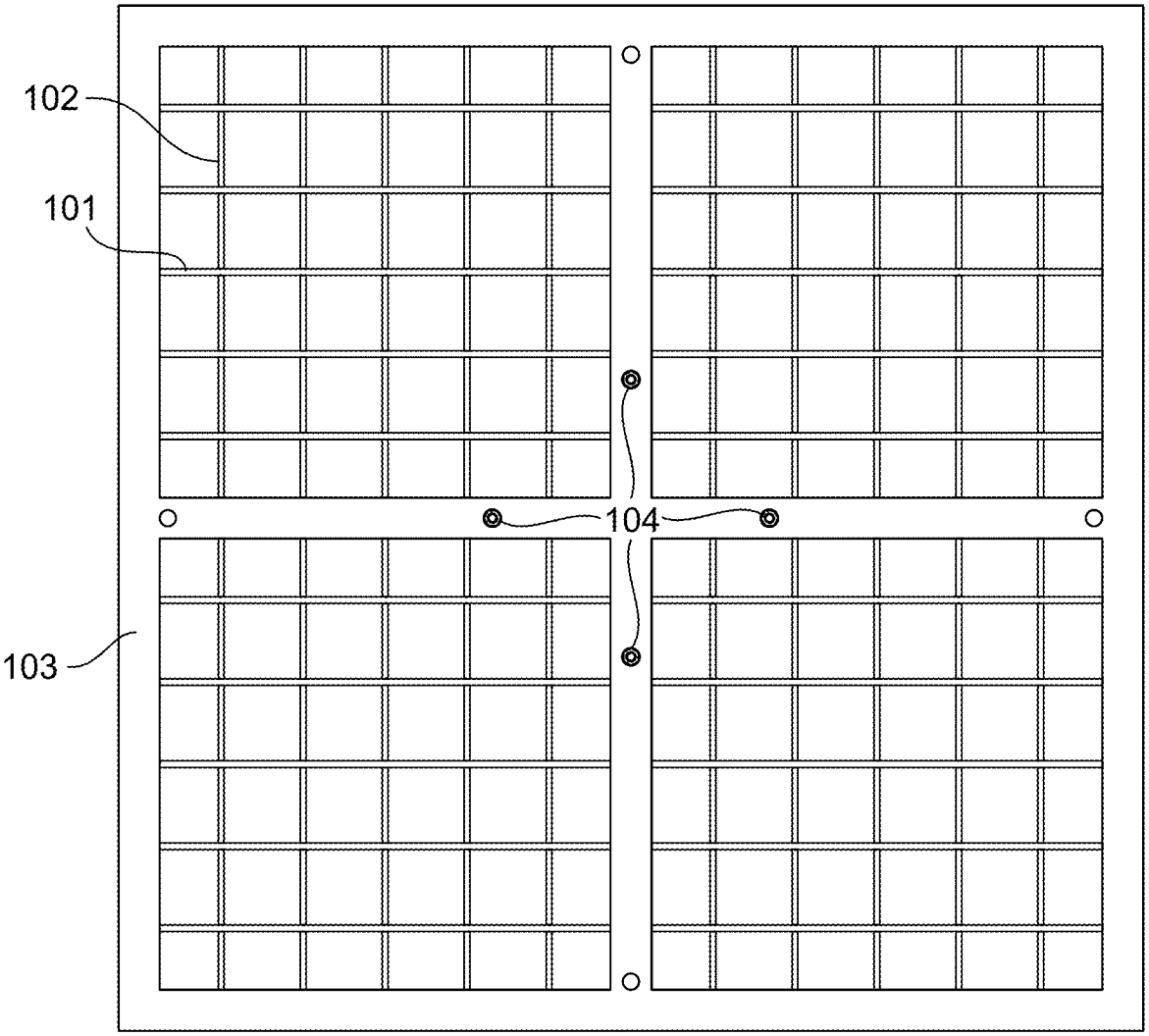
Figure 25:
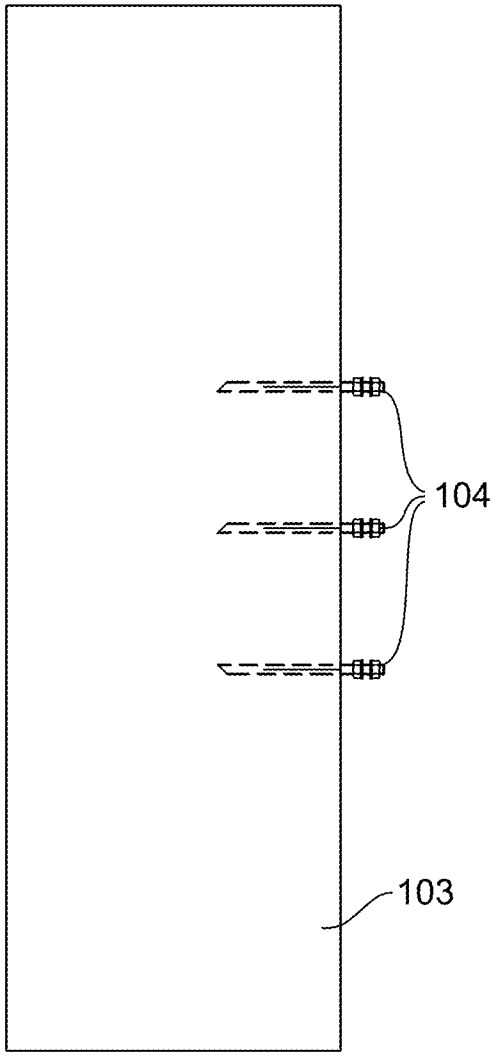
Figure 30:
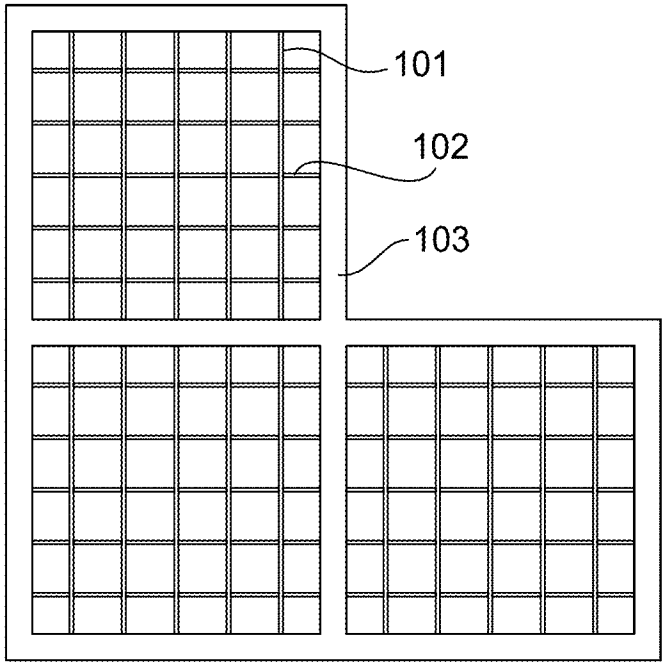
Figure 29:
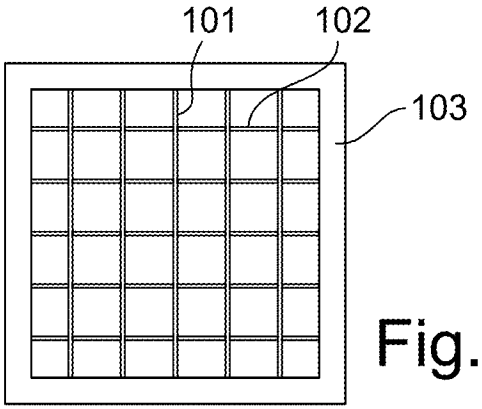
Figure 27:
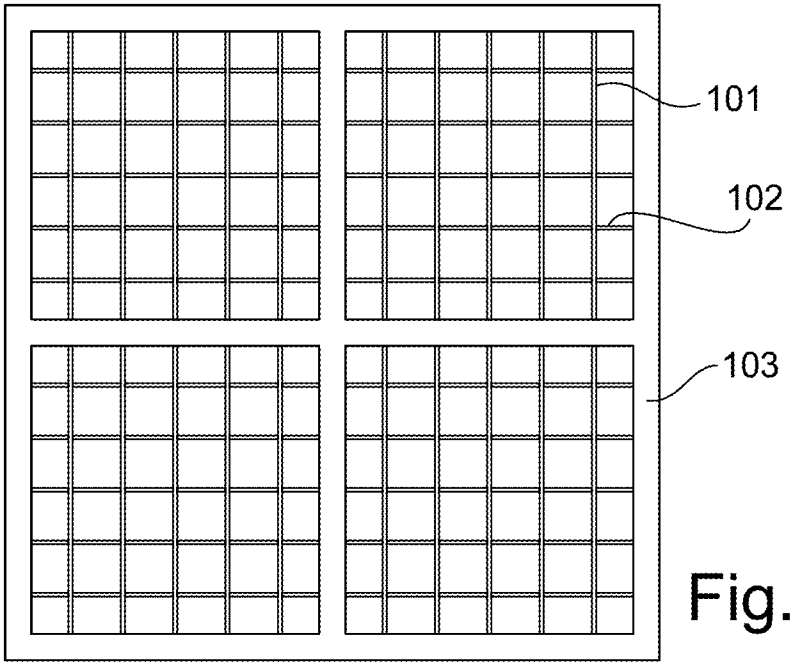
Figure 28:
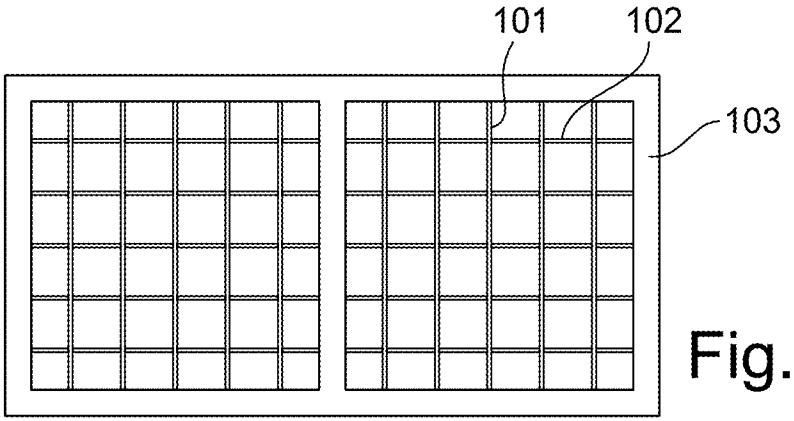
Figure 31:
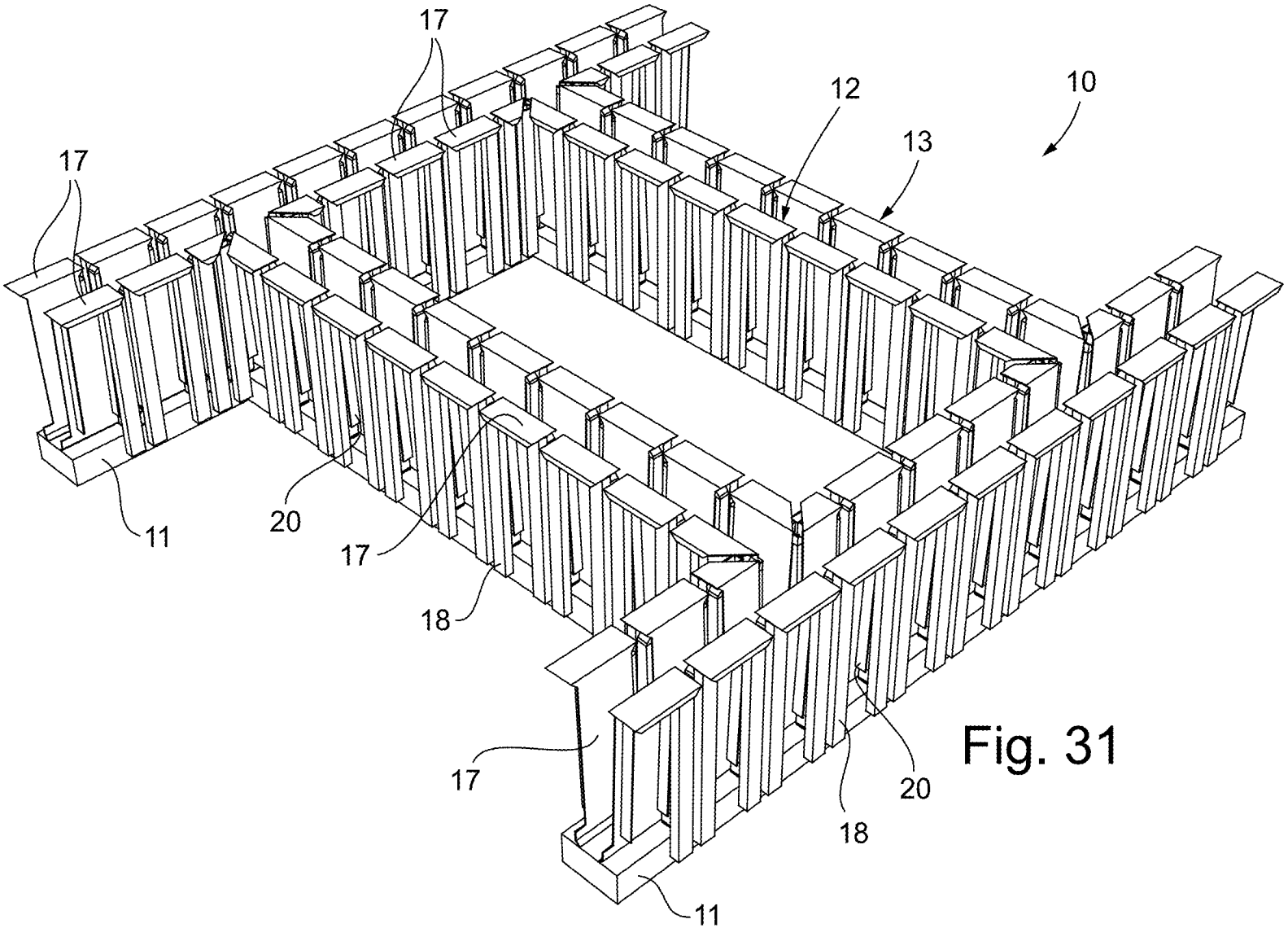
FIGS. 31 to 33 show the possibility of constructing, by virtue of the use of particular inflatable elements, formworks for producing various forms of foundation elements.
Figure 32:
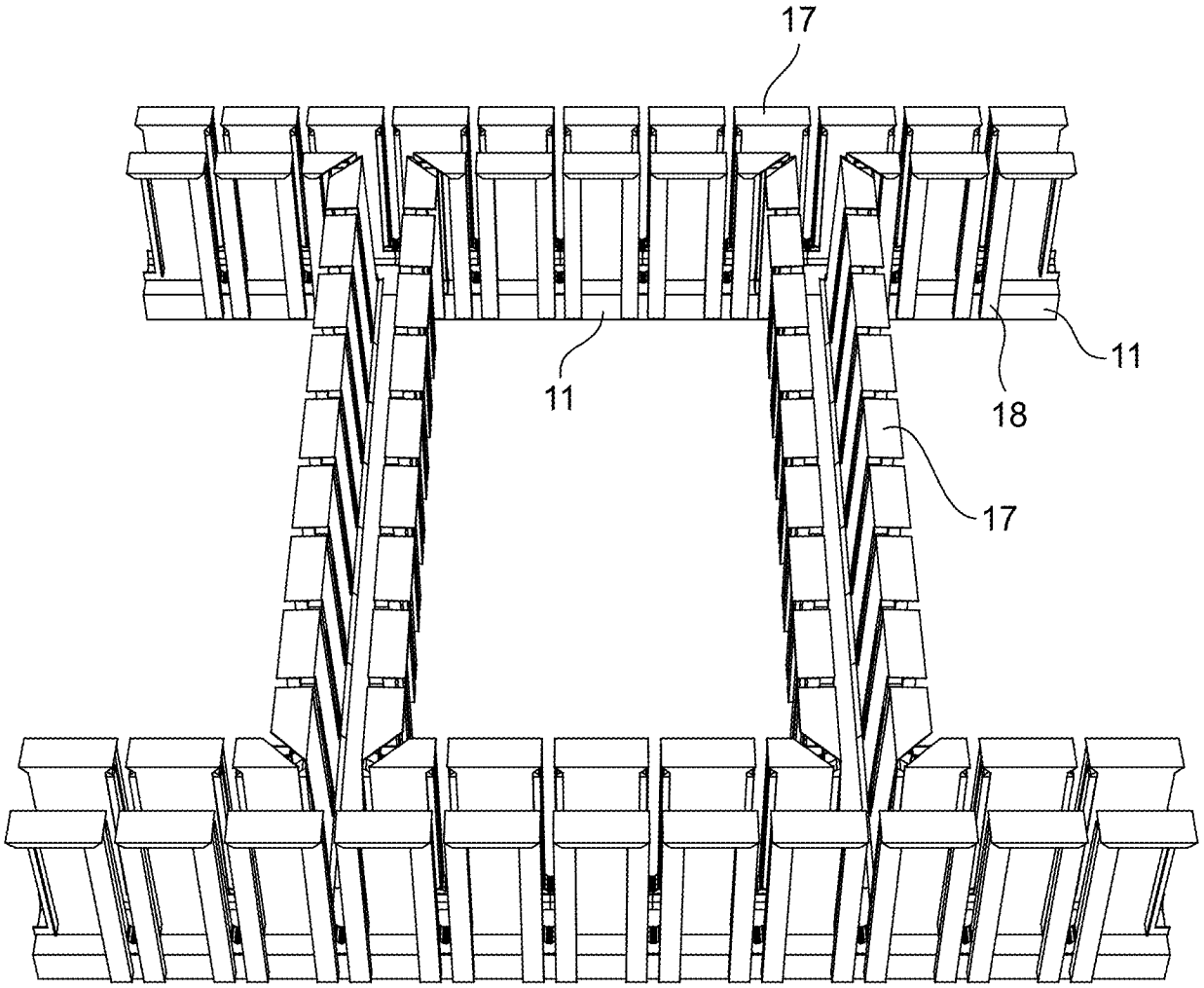
Figure 33:
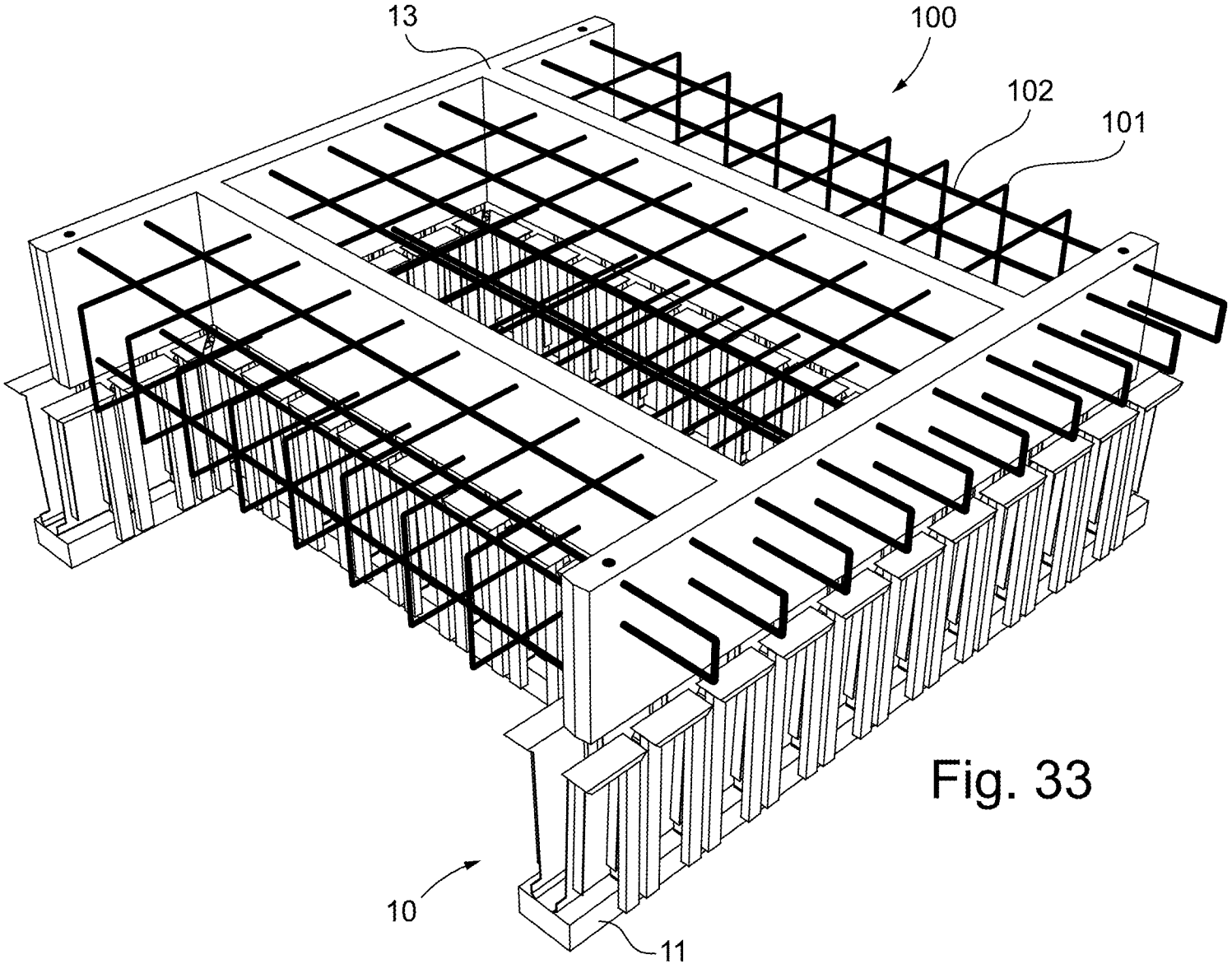
Figure 34:
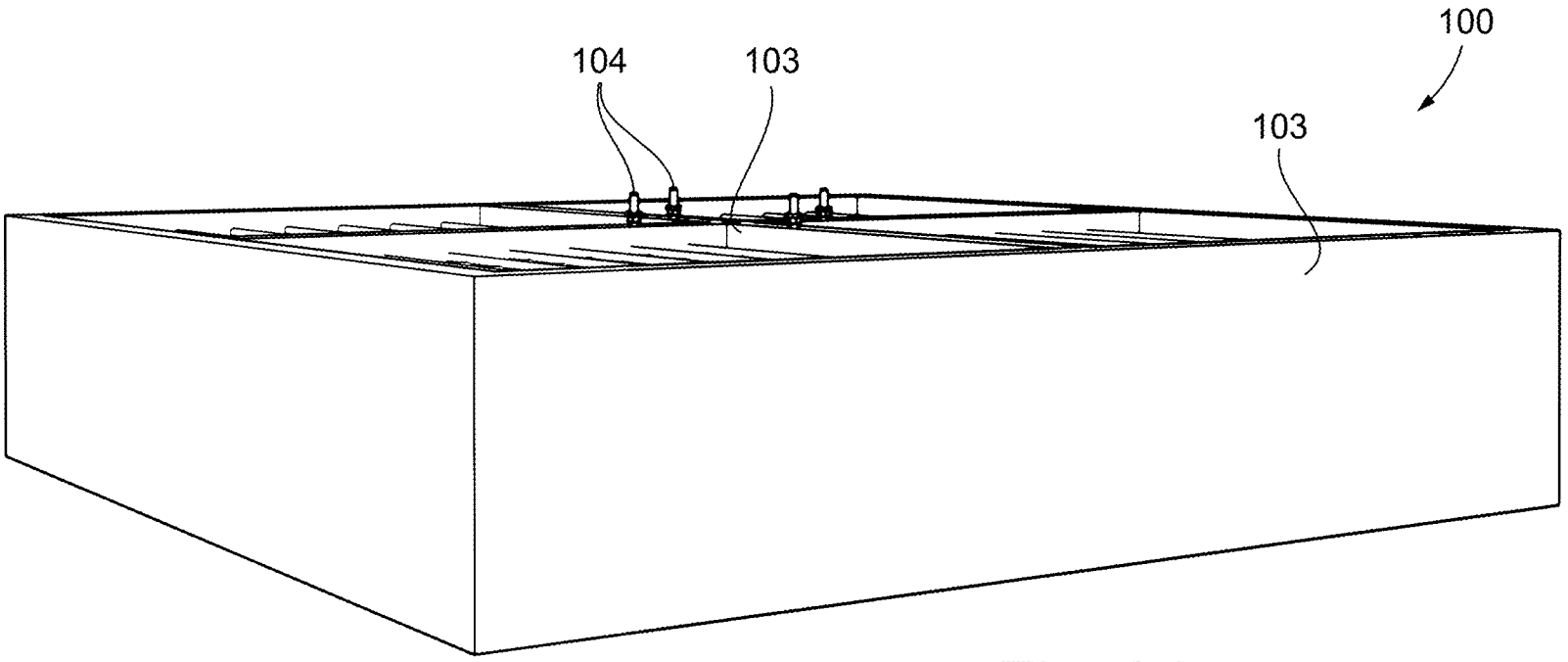
FIGS. 34 to 45 show some steps for providing structures by virtue of the foundation plinth of the present invention.
Figure 35:
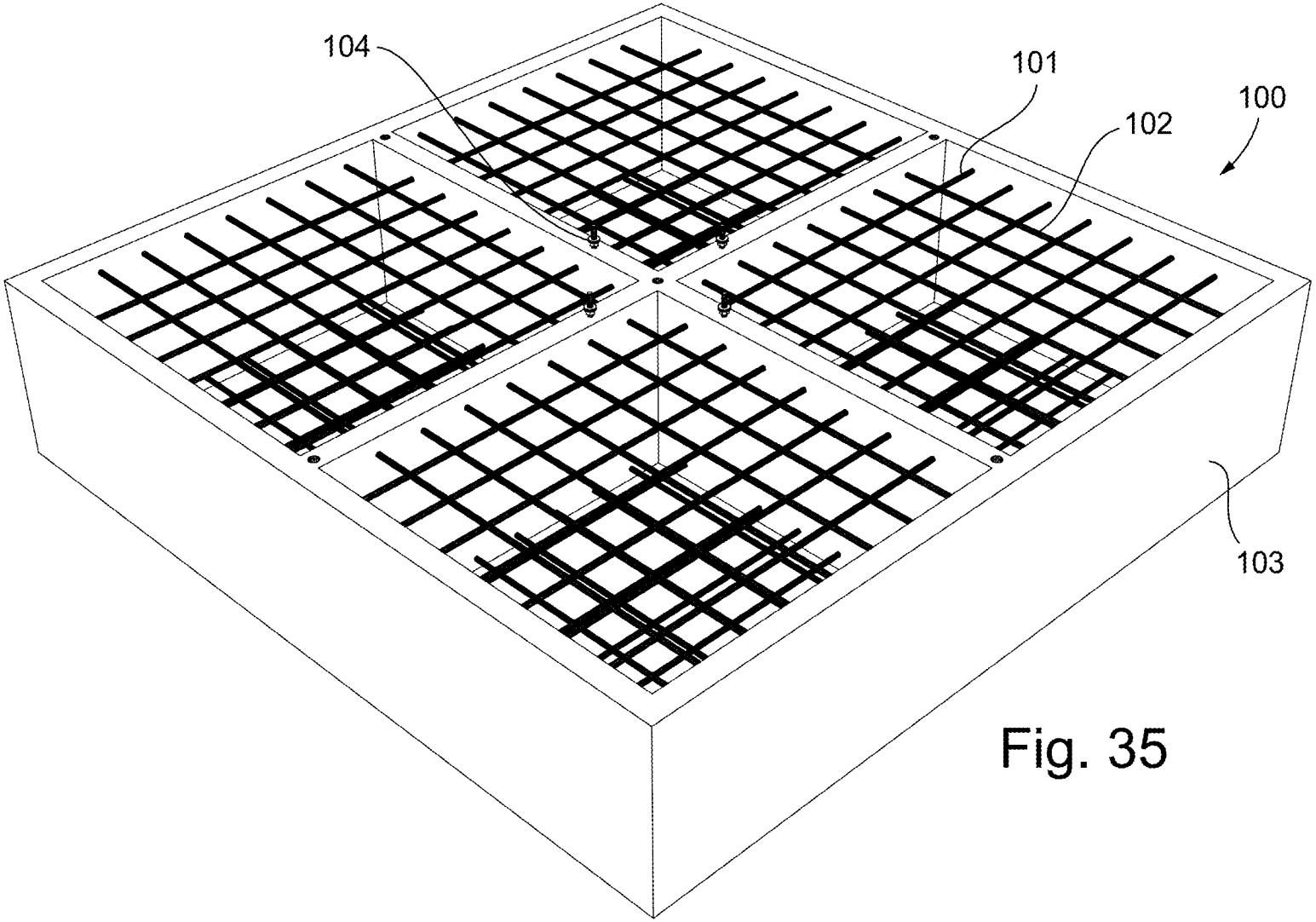
Figure 36:
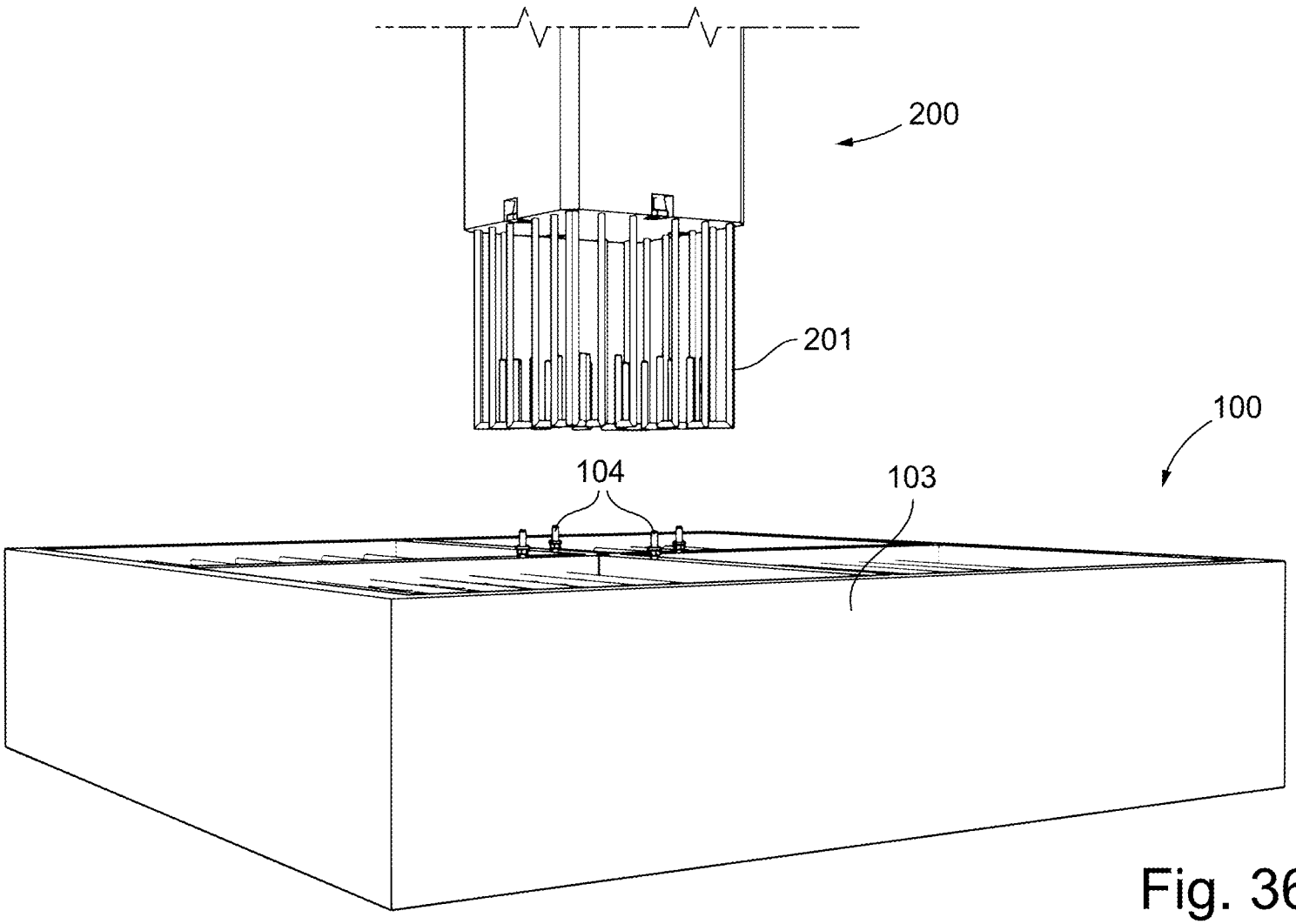
Figure 37:
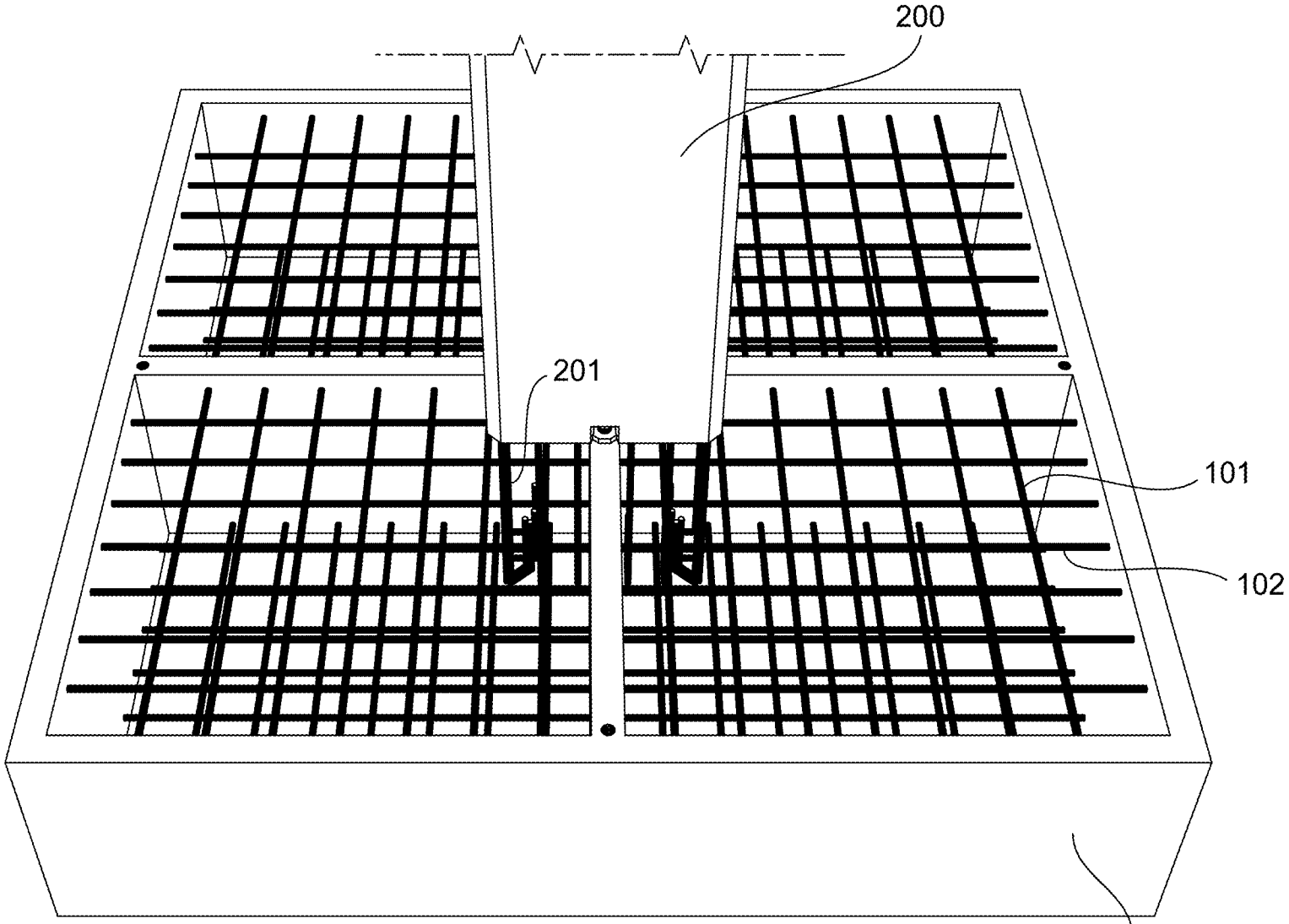
Figure 38:
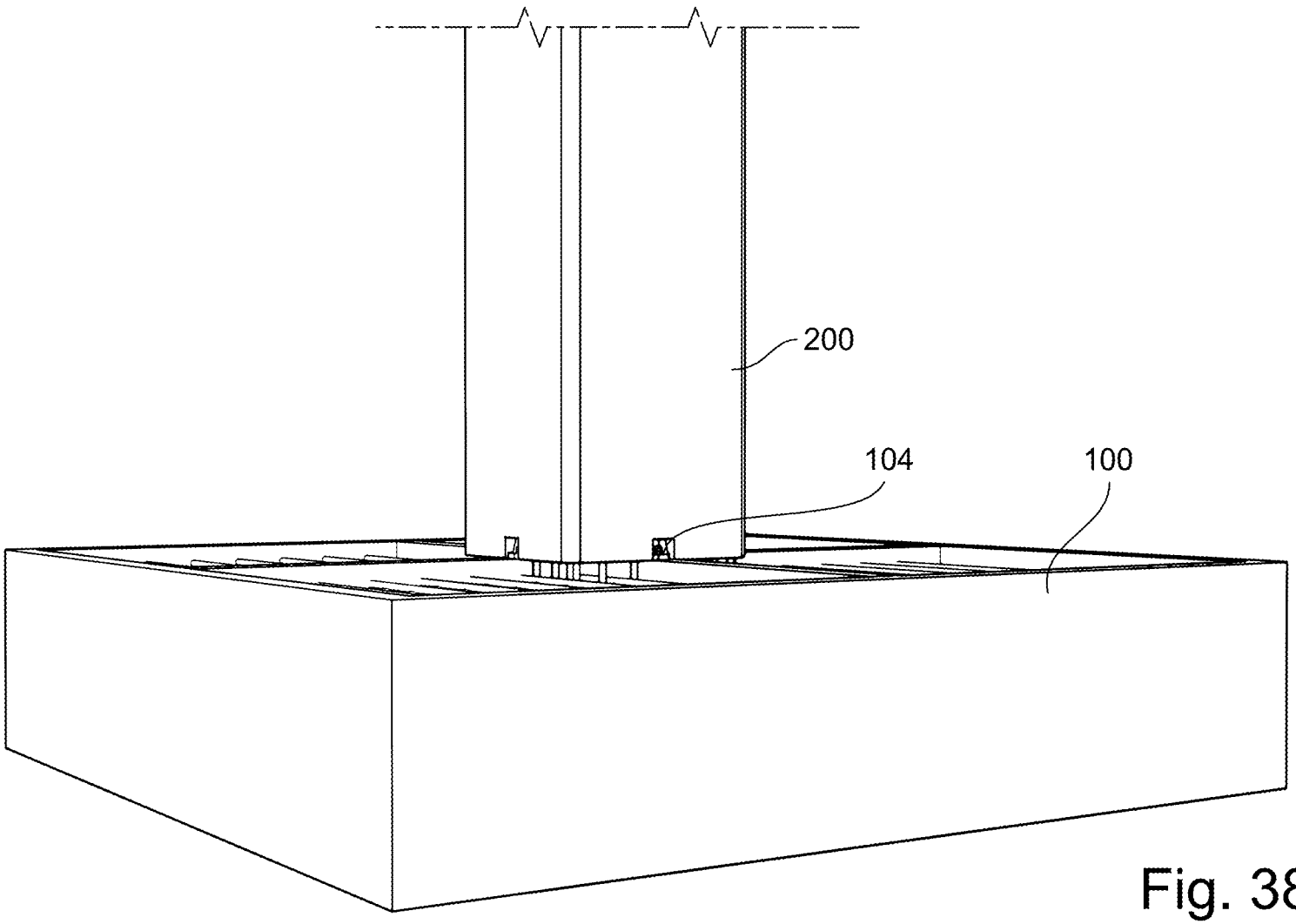
Figure 39:
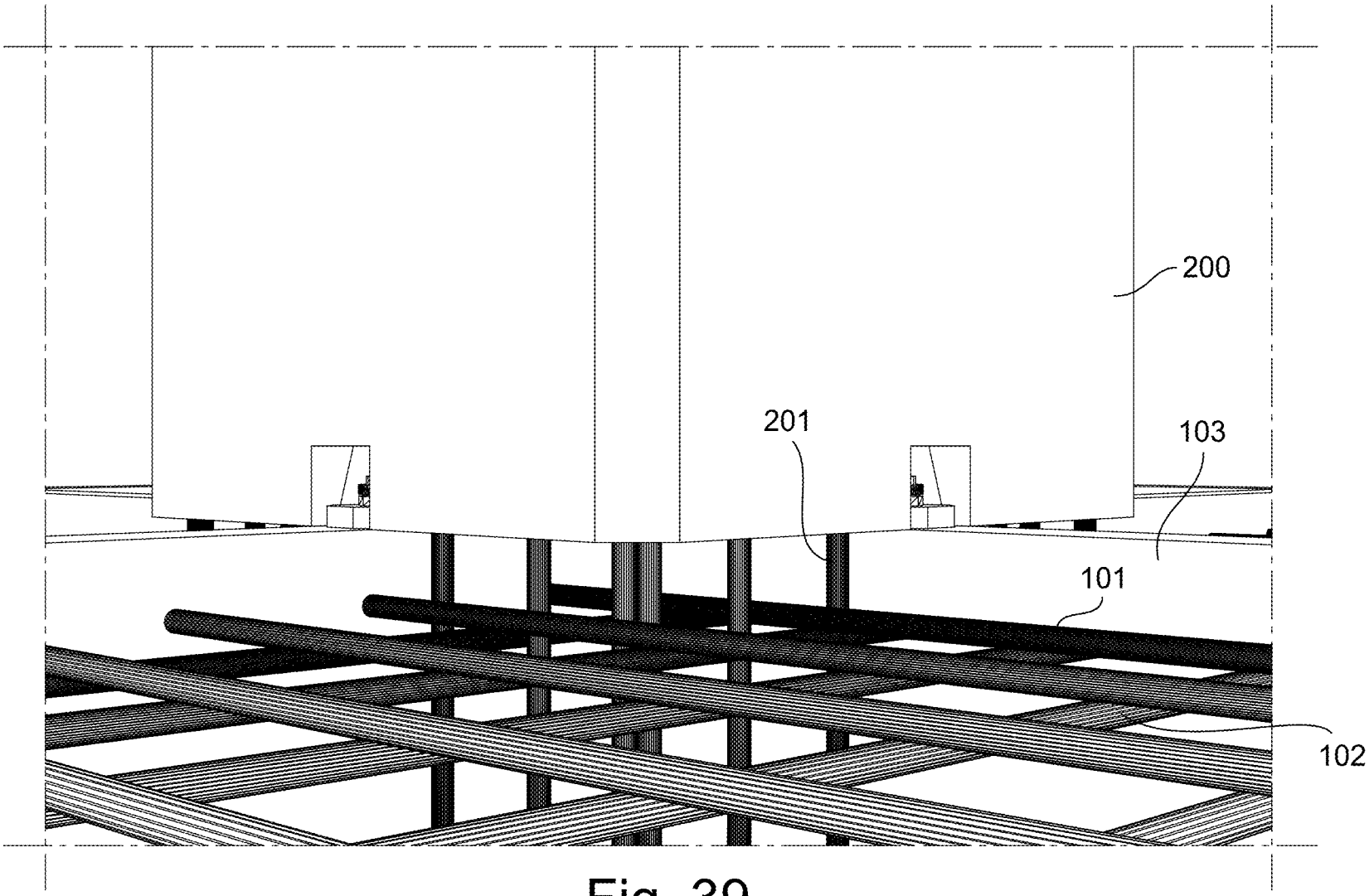
Figure 40:
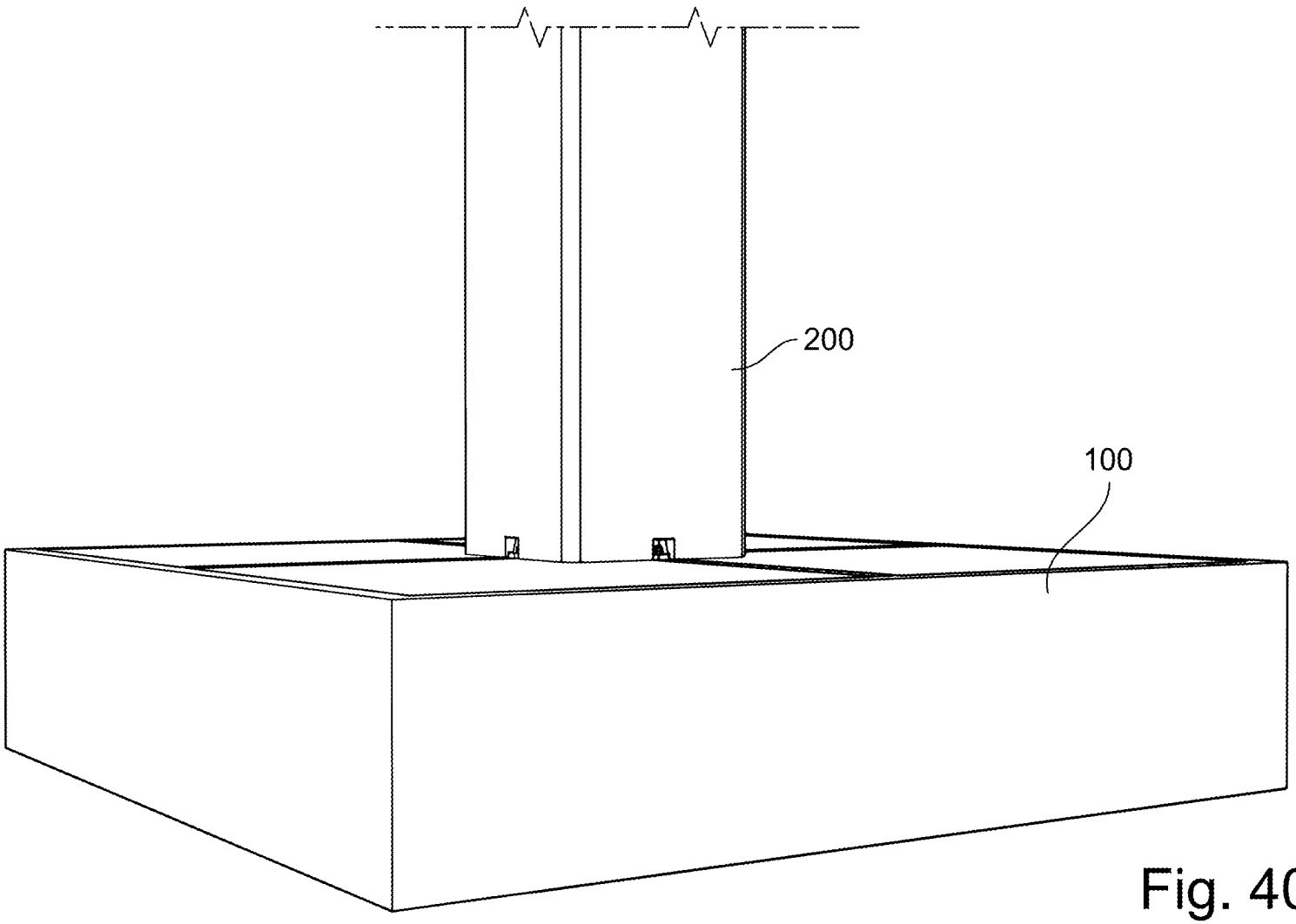
Figure 41:
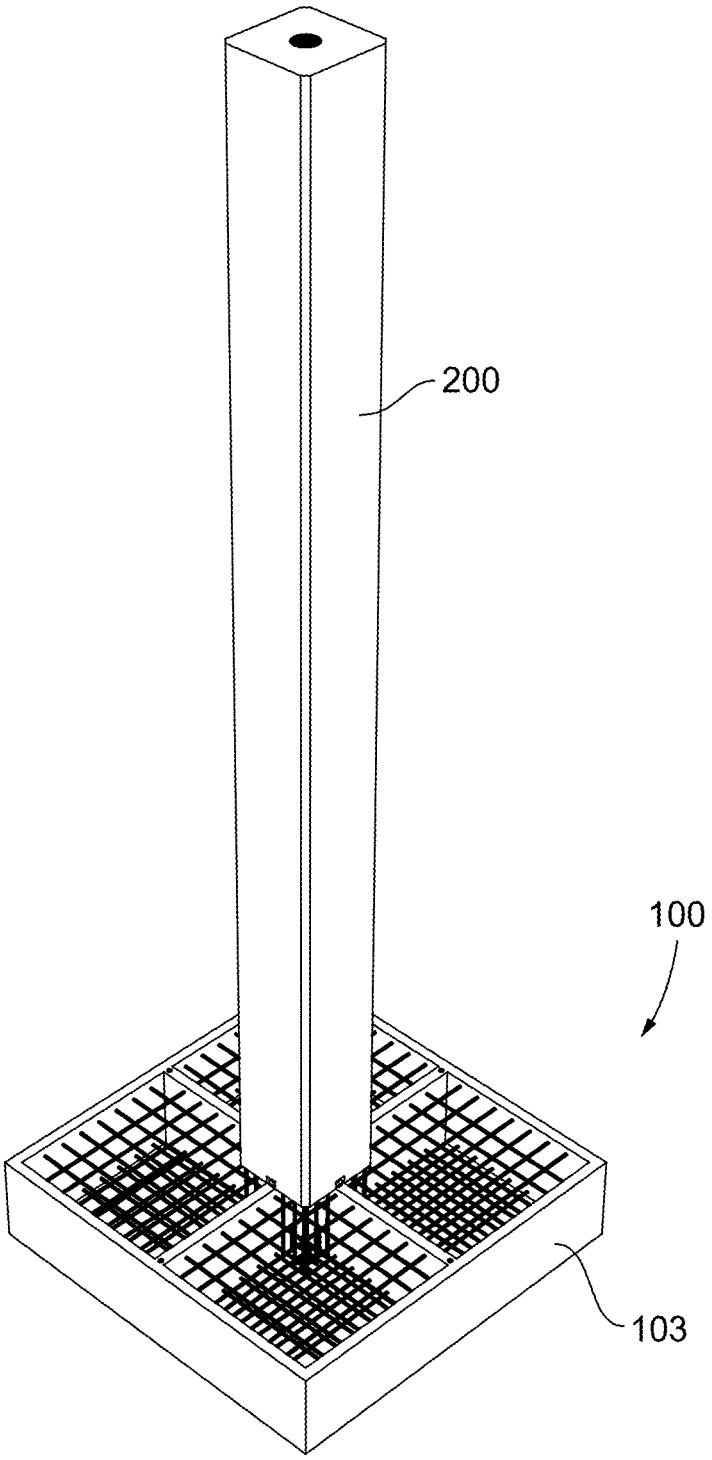
Figure 42:
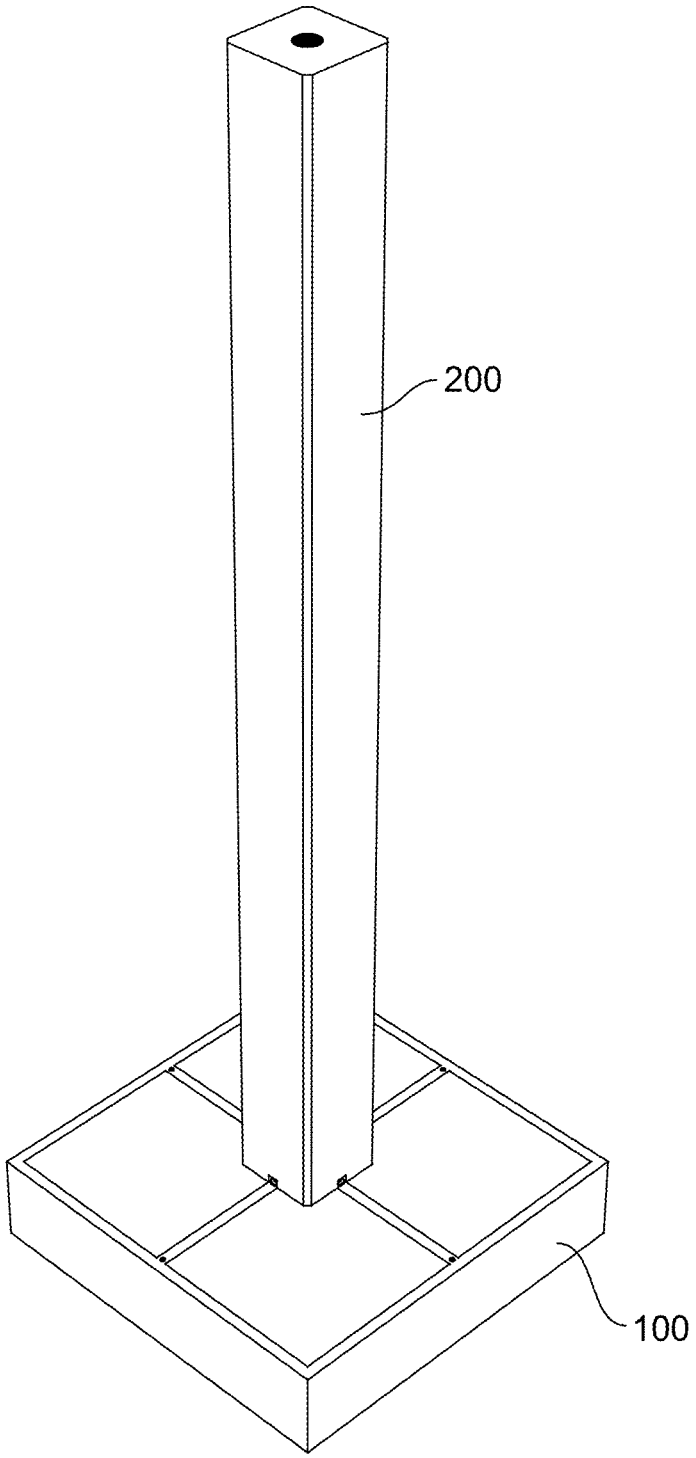
Figure 43:
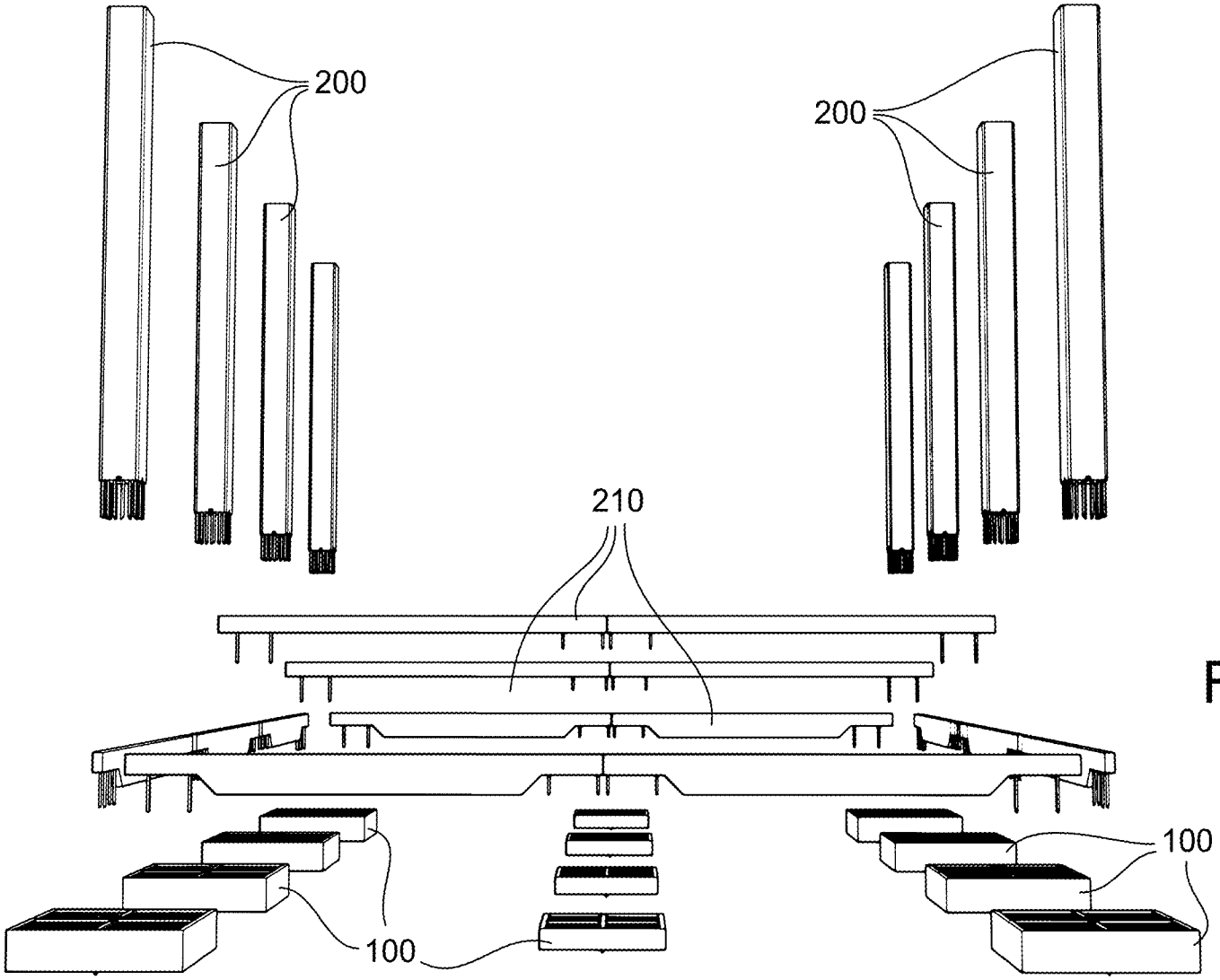
Figure 44:
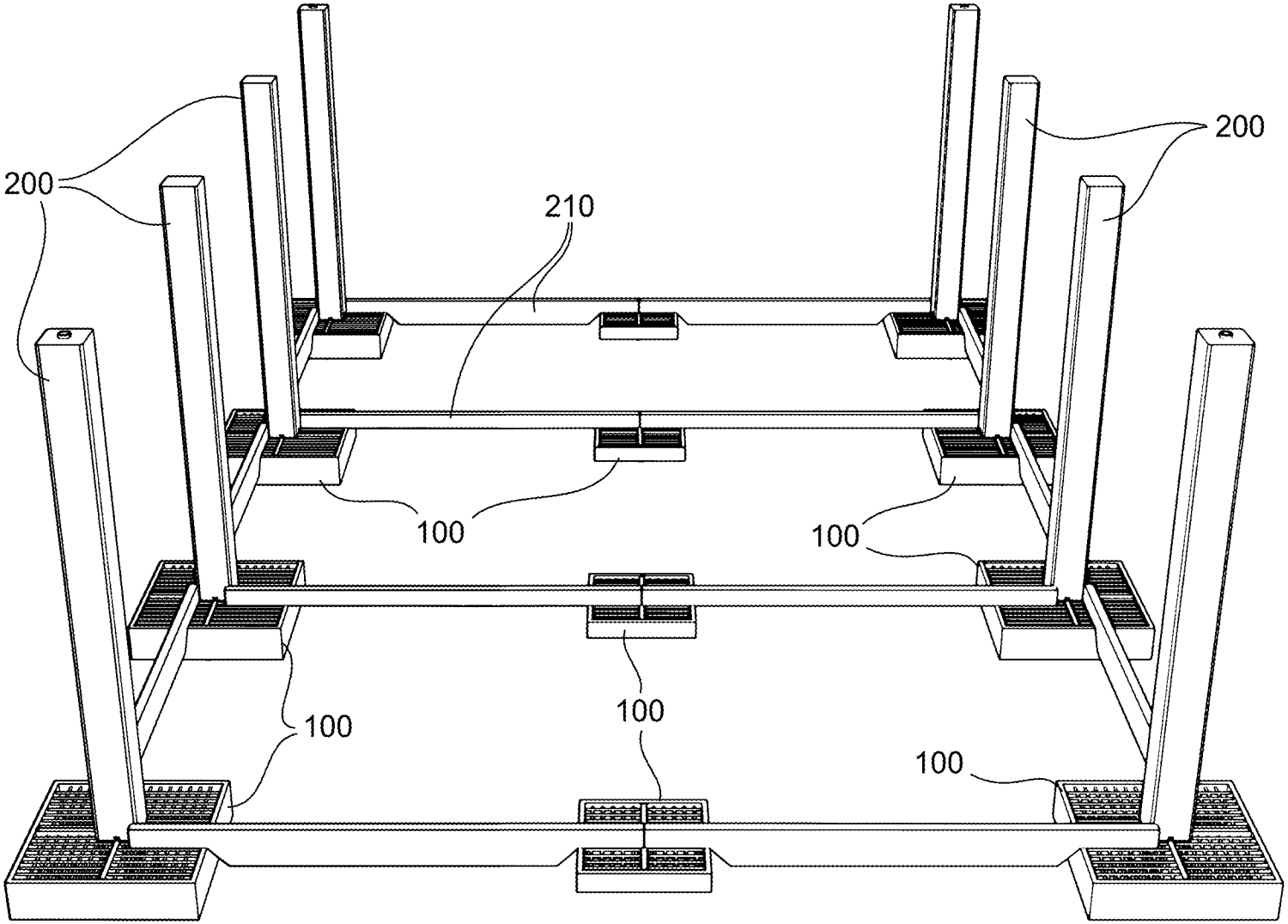
Figure 45:
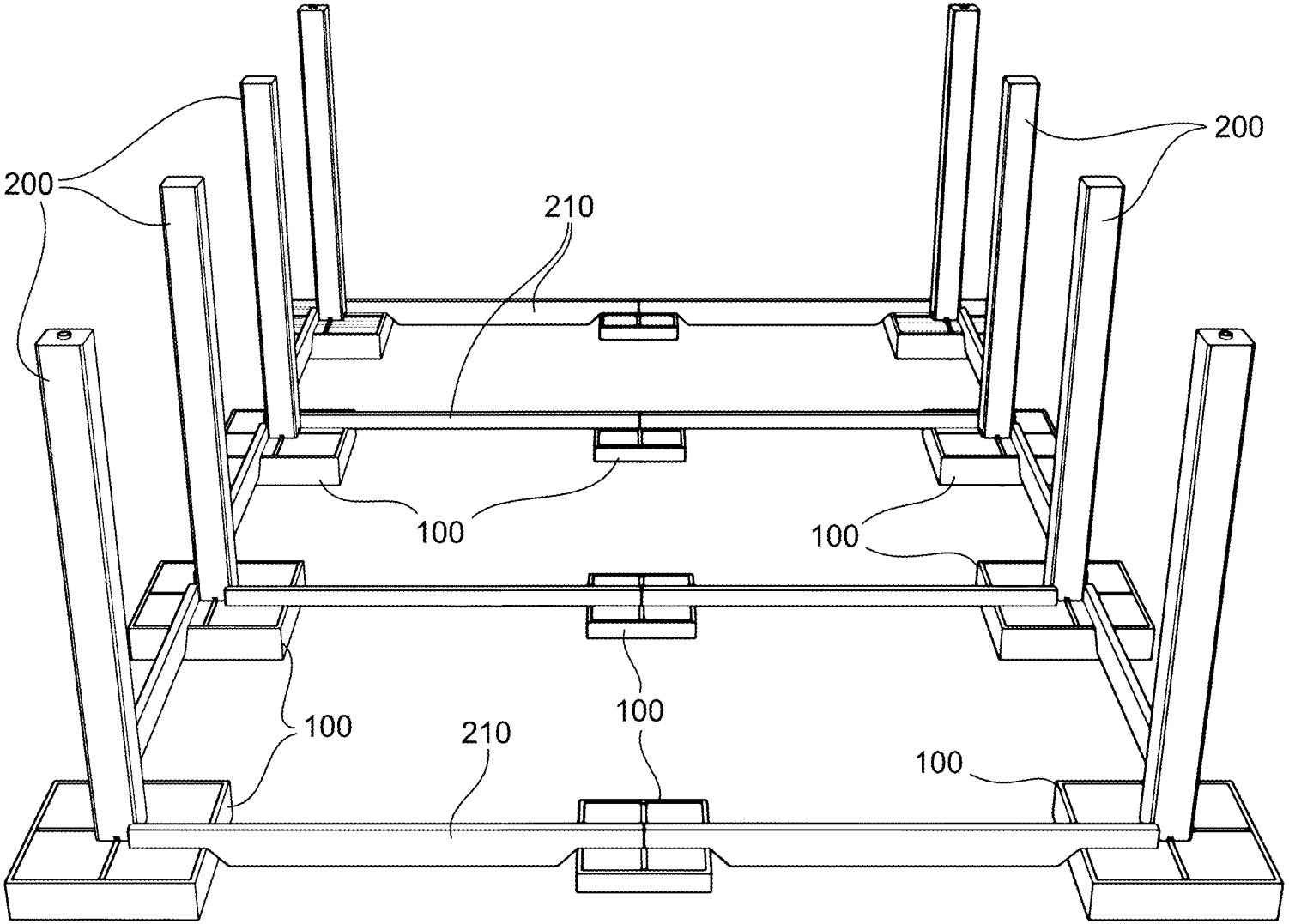

With reference to the figures, the reference numeral 10 generally designates a formwork according to the present invention, the reference numeral 100 designates the innovative foundation plinth obtained therewith and the reference numeral 200 designates the structure provided by joining the foundation plinth 100 and a corresponding pillar 200.

The formwork 10 of the present invention has been conceived for providing a foundation plinth 100 with concrete frame 103 and with exposed horizontal reinforcing bars 101, 102.

As can be seen in the accompanying figures, the frames can be double-T, rectangular, square or any required shape.

Again in general, the exposed horizontal reinforcing bars 101, 102 can have ends that protrude or are embedded in the frame.

The formwork 10 comprises a base 11 the shape of which in plan view corresponds to the concrete frame 103 that it is intended to form.

Inner and outer lateral containment walls 12, 13 are welded at each side of the base 11, such walls extending vertically for the desired height of the plinth, in order to provide a casting chamber 16 for the concrete.

The inner walls 12 all comprise a plurality of openings 14 for the insertion from above of a plurality of longitudinal reinforcing bars 101.

At least one of the outer walls 13 is provided with a corresponding plurality of openings 15 for the insertion by transverse sliding of a plurality of transverse reinforcing bars 102.

It is to be noted that, therefore, the insertion of the transverse bars 102 occurs when the longitudinal bars are already in position.

The openings 14, 15 are provided with inflatable elements 20 which are configured to transition from a deflated configuration, in which the bars can freely slide in the openings 14, 15, to an inflated configuration, in which the bars are locked in position and the chamber 16 is watertight in order to prevent concrete from coming out during casting.

The walls preferably are provided with openings and comprise a plurality of flexible lateral facings 17 which are provided with an upper hook and vertical struts 18.

The inflatable elements 20 are arranged between the lateral facings 17 and the struts 18 so that in the deflated configuration the lateral facings 17 are inclined outward in order to allow the extraction of the foundation plinth 100 and, in this inflated configuration, the lateral facings 17 are substantially vertical in order to provide the frame 103.

Preferably the inflatable elements 20 are U-shaped with a joint portion 21 between the vertical arms 22 which is associated with holes 23 of the base 11 for feeding inflating air or fluids.

In order to allow the correct leveling of the pillar 200, the foundation plinth 100 obtained with a formwork just described comprises elements 104 for adjusting the inclination of the pillar 200 which protrude from the frame 103. Obviously the pillar 200 can be associated in the middle of the plinth or in a lateral position.

By virtue of the foundation plinth 100, it is possible to create a structure with a pillar 200 wherein the pillar is provided with a base for at least partial connection with the frame 103 at the above mentioned adjusting elements 104.

Furthermore, the pillar 200 is provided in a lower region with vertical reinforcing bars 201 which penetrate into the horizontal grid of the bars 102, 103 of the foundation plinth prior to the final casting.

Preferably such vertical reinforcing bars 201 have hook-shaped curved ends and, in a structure with multiple pillars 200, between the corresponding foundation plinths 100 there can be structural connecting elements 210.

Therefore the advantages associated with using the formwork according to the present invention, and the advantages deriving from a formwork thus provided, are immediately obvious.

To sum up, the formwork according to the present invention makes it possible to provide foundation plinths, or in general concrete elements, having reinforcement bars of any diameter protruding horizontally with respect to the direction of concrete casting by virtue of the use of devices that can be inflated with air or liquids.

As described, such inflatable devices seal the formwork prior to the casting of concrete, optimally and without losses, and at the same time they provide a kind of template for supporting the reinforcing bars, by making any tying of the bars unnecessary prior to the casting of the concrete.

In fact, by virtue of the shape structure of the formwork, the reinforcing bars are held inside it, thus superseding the need to prepare tied cages of reinforcing bars in order to then transport them, insert them inside the formwork and space them apart suitably, prior to the casting of concrete.

Furthermore, the formwork allows an easy and rapid extraction of the plinth, since the corresponding facings are welded to the base not in a perfectly perpendicular position, but slightly flared outward. Then, taking advantage of the elastic deflection characteristic of the sheet metal in order to open and close the machine, by way of the inflatable devices connected to the base using holes or connectors, at the end of the process there are gaps between the formwork and the plinth for its rapid extraction.

During the step of closing the formwork, liquid or air is injected into the base which enables the inflatable devices to expand, pressing against the sheet metal columns and forcing the lateral facings to reach the closed stage. The lateral facings have a folding in the upper part, the function of which is to press against the column once the closed position is reached, without closing excessively.

The inflatable devices can be used individually, so that they can be connected to many and varied formworks in order to produce many concrete products, in order to enable the sealing thereof and the protrusion of the horizontal reinforcements from the reinforced concrete elements with respect to the direction of concrete casting.

Therefore the present invention enables the creation of a semi-prefabricated foundation plinth base element which is constituted by a concrete shell that contains all the necessary exposed horizontal reinforcing bars inside it.

The concrete shell can have any shape with parallel opposite sides, such as a simple rectangle or square, but it can also have a central concrete cross or double-T shape.

The function of the concrete shell, or the concrete cross, is to support the pillar element that will be mounted above prior to casting.

Such shell or cross is constructed by leaving anchor bolts embedded inside it, the function of which is to connect and adjust the pillar element. The pillar can also be adjusted without anchor bolts, by using simple props.

Obviously the plinth makes it possible to embed within it simultaneously, in addition to the reinforcements of the pillar, reinforcements for optional connecting beams, beams for bearing prefabricated panels, and reinforcements protruding from foundation piles or micropiles.

As shown, the plinth according to the present invention makes it possible to fasten the pillar without the need to build reinforced concrete accommodation, i.e. socket plinths, and without the need to use particular equipment or mortars and without the creation of overlaps of reinforcements in a critical area where the pillar is connected to the plinth.

Furthermore, the plinth according to the present invention enables an optimization of the foundation pad during the step of structural calculations since it is sufficiently anchored to the bars that protrude from the pillar element, it makes it possible not to use steel structural work on site and it supersedes the meticulous step of tying the reinforcing bars in-situ, it reduces the margin of error on the construction site, it industrializes the construction of the foundation elements, it makes it possible to eliminate the on-site use of pollutant materials, such as oils, form-release agents etc., and it makes it possible to obtain a considerable saving of time and costs in the building of subsurface works.

In particular, by comparing the use of the foundation plinth according to the present invention with the techniques known today, the following advantages can be highlighted.

Therefore technical improvements are achieved with respect to the in-situ casting system.

Such improvements are not only of an economic nature, but are also of a technical nature. In fact, differently from the traditional system, the fastening of the pillar to the foundation occurs with reinforcing bars that protrude from the pillar element and not from the plinth.

This makes it possible to not have an overlapping of the reinforcing bars in a critical area, and to achieve a better fastening between the pillar and the plinth.

Some of the economic advantages are:

- savings of 25/30% on the total costs of foundation work;
- savings of 80% on specialist and qualified labor;
- savings of 60% on execution times;
- savings of 100% on all the ancillary consumable materials such as nails, iron wire, planks of wood, form-release agent etc.
- savings of 100% on hazardous ancillary equipment such as saws, rod bending machines, shears, hammers, tongs, angle grinders.

With respect to the socket plinth construction system, the foundation plinth according to the present invention makes it possible to fasten the pillar directly to the foundation without the assistance of an element that enables its interlocking, i.e. the socket. This configuration considerably reduces costs, because in addition to superseding the construction of the socket in reinforced concrete, it enables a much more rapid adjustment of the pillar element.

With respect to such socket method, the present invention achieves the following economic advantages:

- elimination of the socket, with consequent saving of concrete, steel, and steel structural work (net saving);
- elimination of the steel structural work for building the base of the plinth (net saving);
- no use of qualified labor on site;
- reduction by 20% in earth moving operations, since no panels are mounted for the steel structural works, which would require more extensive earth moving works;
- reduction by 20% of filling material;
- savings of 100% on all the ancillary consumable materials such as: nails, iron wire, planks of wood, form-release agent etc.
- savings of 100% on hazardous ancillary equipment such as: saws, rod bending machines, shears, hammers, tongs, angle grinders.

The improvements made with respect to the connection system using a pillar with protruding bars and corrugated tubes embedded inside the plinth are self-evident.

Firstly, it is no longer necessary to use highly expensive mortars for the fastening between the pillar and the foundation. Secondly, by virtue of the possibility of using hook-shaped bars protruding from the pillar element, the thickness of the present foundation element can be optimized. In fact, in order to be able to use the corrugated tubes technique, the reinforcing bars protruding from the pillar cannot be hook-shaped and therefore it is not possible to optimize the thickness of the foundation during the step of structural calculations.

The thickness is now therefore always restricted by the diameter of the bar protruding from the pillar, in order to be able to ensure the adequate anchoring length of the reinforcing bars.

With respect to such method with corrugated tubes, the present invention achieves the following economic advantages:

- elimination of all corrugated tubes;
- elimination of the template used to mount the corrugated tubes;
- saving of the preparation, transport and mounting of the template with the tubes;
- bypassing of the complex step of adjusting the height of the template;
- bypassing of the complex step of holding in position the tubes and anchor bolts during the step of casting the foundation concrete;
- elimination of the (extremely expensive) expanding mortar used to fill the tubes after mounting the pillar;
- reduction of the thicknesses of the foundation, owing to the possibility of using hook-shaped reinforcing bars at the base of the pillar.
- elimination of the steel structural work for building the base of the plinth (net saving);
- no use of qualified labor on site (e.g. steel structural workers or rodmen);

reduction by 20% in earth moving operations, since no panels are mounted for the steel structural works, which would require more extensive earth moving works;

reduction by 20% of filling material;

savings of 100% on all the ancillary consumable materials such as nails, iron wire, planks of wood, form-release agent etc.

savings of 100% on hazardous ancillary equipment such as saws, rod bending machines, shears, hammers, tongs, angle grinders.

Compared to connections using bolts, the present invention does not require the use of these structural connections and very expensive mortars, and it greatly improves the fastening technique that uses reinforcing bars that start from the base of the foundation element and extend to the top of the pillar.

The economic advantages are the following:

elimination of all shoes for pillars which have structural functions;

elimination of all the anchor bolts used in the foundation which have structural functions;

elimination of the template used to mount the anchor bolts;

saving of the preparation, transport and mounting of the template for the anchor bolts;

bypassing of the complex step of adjusting the height of the template;

bypassing of the complex step of holding in position the template during the step of casting the foundation concrete;

elimination of the (extremely expensive) expanding mortar used to fill the base of the pillar;

elimination of the steel structural work for building the base of the plinth (net saving);

no use of qualified labor on site (e.g. steel structural workers or rodmen);

reduction by 20% in earth moving operations, since no panels are mounted for the steel structural works, which would require more extensive earth moving works);

reduction by 20% of filling material;

savings of 100% on all the ancillary consumable materials such as nails, iron wire, planks of wood, form-release agent etc.

savings of 100% on hazardous ancillary equipment such as saws, rod bending machines, shears, hammers, tongs, angle grinders.

In conclusion, the pillar/plinth fastening obtained using the formwork according to the present invention, compared to the state of the art, is indisputably more efficient and economic.

The present invention thus conceived is susceptible of numerous modifications and variations, all of which are within the scope of the appended claims; moreover, all the details may be substituted by other, technically equivalent elements. In practice the materials employed, and their dimensions, may be any according to the technical requirements.

The disclosures in Italian Patent Application No. 102015000080210 (UB2015A006233) from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A formwork for providing a plinth with concrete frame and with exposed horizontal reinforcing bars, comprising a base the shape of which in plan view corresponds to said concrete frame, each side of said base being provided with inner and outer lateral containment walls which extend vertically from said base to make a casting chamber for said concrete, said inner walls comprising a plurality of openings for the insertion from above of a plurality of longitudinal reinforcing bars, at least one of said outer walls being provided with a plurality of openings for the insertion by transverse sliding of a plurality of transverse reinforcing bars, said openings being provided with inflatable elements which are configured to transition from a deflated configuration, in which said bars can freely slide in said openings, to an inflated configuration, in which said bars are locked in position and said chamber is watertight in order to prevent concrete from coming out during casting.

2. The formwork according to claim 1, wherein said walls provided with said openings comprise a plurality of flexible lateral facings which are provided with an upper hook and vertical struts, said inflatable elements being arranged between said lateral facings and said struts, so that in said deflated configuration said lateral facings are inclined outward in order to allow the extraction of said plinth and in said inflated configuration said lateral facings are substantially vertical in order to make said frame.

3. The formwork according to claim 1, wherein said inflatable elements are U-shaped, with a joint portion between the vertical arms which is associated with holes of said base for feeding inflating air or fluids to said inflatable elements.

* * * * *